US006195110B1

(12) United States Patent
Kokubo et al.

(10) Patent No.: US 6,195,110 B1
(45) Date of Patent: Feb. 27, 2001

(54) THERMAL PRINTING METHOD AND APPARATUS HAVING GROUPS OF SEPARATELY DRIVE HEATING ELEMENTS IN THE THERMAL HEAD

(75) Inventors: Hideyuki Kokubo; Tomoyoshi Nishimura, both of Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/122,654

(22) Filed: Jul. 27, 1998

(30) Foreign Application Priority Data

Jul. 28, 1997 (JP) ..... 9-201483
Sep. 16, 1997 (JP) ..... 9-250551

(51) Int. Cl.[7] ..... B41J 2/355
(52) U.S. Cl. ..... 347/182; 347/180; 347/181
(58) Field of Search ..... 347/180, 181, 347/182, 183, 171, 172, 175

(56) References Cited

U.S. PATENT DOCUMENTS 4,575,732 * 3/1986 Kitaoka ..... 347/180
5,075,701 * 12/1991 Arai ..... 347/182
5,587,732 * 12/1996 Kokubo ..... 347/172
5,682,504 * 10/1997 Kimura et al. ..... 347/180
5,724,085 * 3/1998 Inui et al. ..... 347/175

FOREIGN PATENT DOCUMENTS 63-275268 11/1988 (JP) ..... H04N/1/23
3-39262 2/1991 (JP) ..... B41J/2/355
6-270454 9/1994 (JP) ..... B41J/2/36

* cited by examiner

*Primary Examiner*—N. Le
*Assistant Examiner*—Hai C. Pham
(74) *Attorney, Agent, or Firm*—Sughrue, Mion, Zinn, Macpeak & Seas, PLLC

(57) ABSTRACT

A thermal head has plural heating elements arranged in line in a main scan direction. The heating elements are supplied with a train of drive pulses while the thermosensitive recording sheet is conveyed in a sub scan direction crosswise to the main scan direction, for thermal recording to the recording material by one line. The heating elements are grouped into first and second groups. The drive pulse train for the first group of the heating elements is determined by starting the drive pulse train at a start of the one line. The drive pulse train for the second group of the heating elements is determined by ending the drive pulse train at an end of the one line.

33 Claims, 20 Drawing Sheets

FIG. 10A

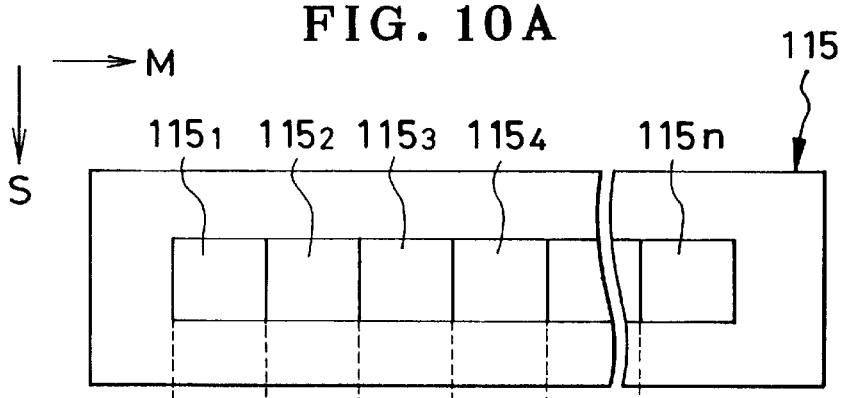

FIG. 10B

| | | | | | | | | |
|---|---|---|---|---|---|---|---|---|
| 1ST SUB-LINE | B | K | B | K | B | K | 1/2 | ONE LINE |
| 2ND SUB-LINE | K | B | K | B | K | B | 1/2 | |
| 1ST SUB-LINE | B | K | B | K | B | K | 1/2 | ONE LINE |
| 2ND SUB-LINE | K | B | K | B | K | B | 1/2 | |
| 1ST SUB-LINE | B | K | B | K | B | K | 1/2 | ONE LINE |
| 2ND SUB-LINE | K | B | K | B | K | B | 1/2 | |

FIG. 10C

| | | | | | | | | |
|---|---|---|---|---|---|---|---|---|
| 1ST SUB-LINE | K | B | K | B | K | B | 1/2 | ONE LINE |
| 2ND SUB-LINE | B | K | B | K | B | K | 1/2 | |
| 1ST SUB-LINE | K | B | K | B | K | B | 1/2 | ONE LINE |
| 2ND SUB-LINE | B | K | B | K | B | K | 1/2 | |
| 1ST SUB-LINE | K | B | K | B | K | B | 1/2 | ONE LINE |
| 2ND SUB-LINE | B | K | B | K | B | K | 1/2 | |

FIG. 10D

| | | | | | | | | |
|---|---|---|---|---|---|---|---|---|
| 1ST SUB-LINE | B | B | B | B | B | B | 1/2 | ONE LINE |
| 2ND SUB-LINE | K | K | K | K | K | K | 1/2 | |
| 1ST SUB-LINE | B | B | B | B | B | B | 1/2 | ONE LINE |
| 2ND SUB-LINE | K | K | K | K | K | K | 1/2 | |
| 1ST SUB-LINE | B | B | B | B | B | B | 1/2 | ONE LINE |
| 2ND SUB-LINE | K | K | K | K | K | K | 1/2 | |

FIG. 15A

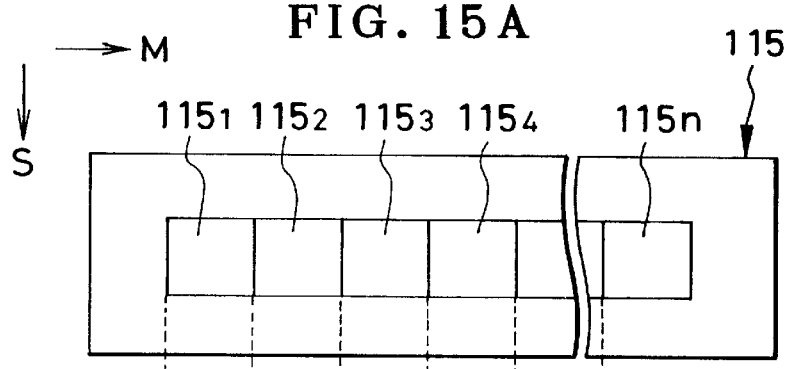

FIG. 15B

| | | | | | | | | |
|---|---|---|---|---|---|---|---|---|
| 1ST SUB-LINE | B | R | K2 | K1 | B | R | 1/4 | ONE LINE |
| 2ND SUB-LINE | K1 | B | R | K2 | K1 | B | 1/4 | |
| 3RD SUB-LINE | K2 | K1 | B | R | K2 | K1 | 1/4 | |
| 4TH SUB-LINE | R | K2 | K1 | B | R | K2 | 1/4 | |
| 1ST SUB-LINE | B | R | K2 | K1 | B | R | 1/4 | ONE LINE |
| 2ND SUB-LINE | K1 | B | R | K2 | K1 | B | 1/4 | |
| 3RD SUB-LINE | K2 | K1 | B | R | K2 | K1 | 1/4 | |

FIG. 15C

| | | | | | | | | |
|---|---|---|---|---|---|---|---|---|
| 1ST SUB-LINE | K1 | K2 | R | B | K1 | K2 | 1/4 | ONE LINE |
| 2ND SUB-LINE | K2 | R | B | K1 | K2 | R | 1/4 | |
| 3RD SUB-LINE | R | B | K1 | K2 | R | B | 1/4 | |
| 4TH SUB-LINE | B | K1 | K2 | R | B | K1 | 1/4 | |
| 1ST SUB-LINE | K1 | K2 | R | B | K1 | K2 | 1/4 | ONE LINE |
| 2ND SUB-LINE | K2 | R | B | K1 | K2 | R | 1/4 | |
| 3RD SUB-LINE | R | B | K1 | K2 | R | B | 1/4 | |

FIG. 15D

| | | | | | | | | |
|---|---|---|---|---|---|---|---|---|
| 1ST SUB-LINE | B | K2 | R | K1 | B | K2 | 1/4 | ONE LINE |
| 2ND SUB-LINE | K1 | R | B | K2 | K1 | R | 1/4 | |
| 3RD SUB-LINE | K2 | B | K1 | R | K2 | B | 1/4 | |
| 4TH SUB-LINE | R | K1 | K2 | B | R | K1 | 1/4 | |
| 1ST SUB-LINE | B | K2 | R | K1 | B | K2 | 1/4 | ONE LINE |
| 2ND SUB-LINE | K1 | R | B | K2 | K1 | R | 1/4 | |
| 3RD SUB-LINE | K2 | B | K1 | R | K2 | B | 1/4 | |

FIG. 19A

| S \ M | | | | | | | |
|---|---|---|---|---|---|---|---|
| 1ST SUB-LINE | B | R | K3 | K2 | K1 | B | 1/5 |
| 2ND SUB-LINE | K1 | B | R | K3 | K2 | K1 | 1/5 |
| 3RD SUB-LINE | K2 | K1 | B | R | K3 | K2 | 1/5 |
| 4TH SUB-LINE | K3 | K2 | K1 | B | R | K3 | 1/5 |
| 5TH SUB-LINE | R | K3 | K2 | K1 | B | R | 1/5 |
| 1ST SUB-LINE | B | R | K3 | K2 | K1 | B | 1/5 |
| 2ND SUB-LINE | K1 | B | R | K3 | K2 | K1 | 1/5 |

ONE LINE

FIG. 19B

| S \ M | | | | | | | |
|---|---|---|---|---|---|---|---|
| 1ST SUB-LINE | K1 | K2 | R | B | K1 | K2 | 1/4 |
| 2ND SUB-LINE | K2 | R | B | K1 | K2 | R | 1/4 |
| 3RD SUB-LINE | R | B | K1 | K2 | R | B | 1/4 |
| 4TH SUB-LINE | B | K1 | K2 | R | B | K1 | 1/4 |
| 1ST SUB-LINE | K1 | K2 | R | B | K1 | K2 | 1/4 |
| 2ND SUB-LINE | K2 | R | B | K1 | K2 | R | |

ONE LINE

FIG. 19C

| S \ M | | | | | | | |
|---|---|---|---|---|---|---|---|
| 1ST SUB-LINE | K | B | R | K | B | R | 1/3 |
| 2ND SUB-LINE | R | K | B | R | K | B | 1/3 |
| 3RD SUB-LINE | B | R | K | B | R | K | 1/3 |
| 1ST SUB-LINE | K | B | R | K | B | R | 1/3 |
| 2ND SUB-LINE | R | K | B | R | K | B | 1/3 |

ONE LINE

FIG. 21A

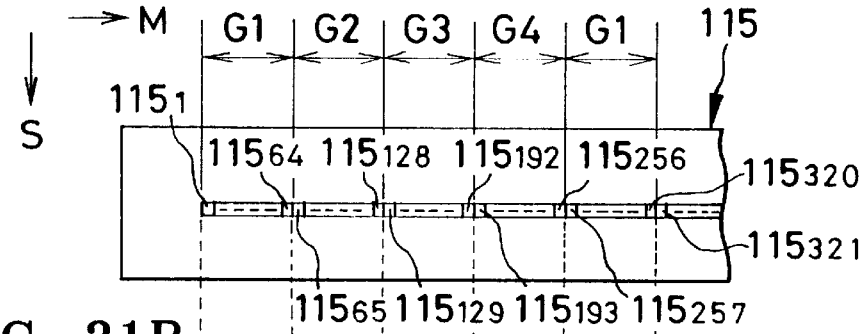

FIG. 21B

| | | | | | | | | |
|---|---|---|---|---|---|---|---|---|
| 1ST SUB-LINE | B | R | K2 | K1 | B | R | 1/4 | ONE LINE |
| 2ND SUB-LINE | K1 | B | R | K2 | K1 | B | 1/4 | |
| 3RD SUB-LINE | K2 | K1 | B | R | K2 | K1 | 1/4 | |
| 4TH SUB-LINE | R | K2 | K1 | B | R | K2 | 1/4 | |
| 1ST SUB-LINE | B | R | K2 | K1 | B | R | 1/4 | ONE LINE |
| 2ND SUB-LINE | K1 | B | R | K2 | K1 | B | 1/4 | |
| 3RD SUB-LINE | K2 | K1 | B | R | K2 | K1 | 1/4 | |

FIG. 21C

| | | | | | | | | |
|---|---|---|---|---|---|---|---|---|
| 1ST SUB-LINE | K1 | K2 | R | B | K1 | K2 | 1/4 | ONE LINE |
| 2ND SUB-LINE | K2 | R | B | K1 | K2 | R | 1/4 | |
| 3RD SUB-LINE | R | B | K1 | K2 | R | B | 1/4 | |
| 4TH SUB-LINE | B | K1 | K2 | R | B | K1 | 1/4 | |
| 1ST SUB-LINE | K1 | K2 | R | B | K1 | K2 | 1/4 | ONE LINE |
| 2ND SUB-LINE | K2 | R | B | K1 | K2 | R | 1/4 | |
| 3RD SUB-LINE | R | B | K1 | K2 | R | B | 1/4 | |

FIG. 21D

| | | | | | | | | |
|---|---|---|---|---|---|---|---|---|
| 1ST SUB-LINE | B | K2 | R | K1 | B | K2 | 1/4 | ONE LINE |
| 2ND SUB-LINE | K1 | R | B | K2 | K1 | R | 1/4 | |
| 3RD SUB-LINE | K2 | B | K1 | R | K2 | B | 1/4 | |
| 4TH SUB-LINE | R | K1 | K2 | B | R | K1 | 1/4 | |
| 1ST SUB-LINE | B | K2 | R | K1 | B | K2 | 1/4 | ONE LINE |
| 2ND SUB-LINE | K1 | R | B | K2 | K1 | R | 1/4 | |
| 3RD SUB-LINE | K2 | B | K1 | R | K2 | B | 1/4 | |

FIG. 22A
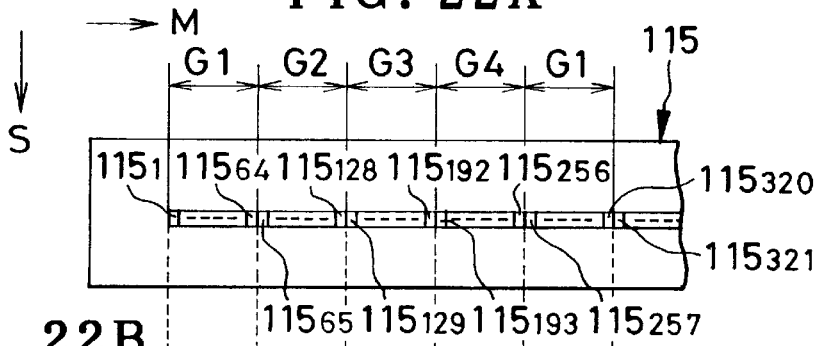
FIG. 22B
| | | | | | | | | |
|---|---|---|---|---|---|---|---|---|
| 1ST SUB-LINE | B | R | K2 | K1 | B | R | 1/4 | ONE LINE |
| 2ND SUB-LINE | K1 | B | R | K2 | K1 | B | 1/4 | |
| 3RD SUB-LINE | K2 | K1 | B | R | K2 | K1 | 1/4 | |
| 4TH SUB-LINE | R | K2 | K1 | B | R | K2 | 1/4 | |
| 1ST SUB-LINE | B | R | K2 | K1 | B | R | 1/4 | ONE LINE |
| 2ND SUB-LINE | K1 | B | R | K2 | K1 | B | 1/4 | |
| 3RD SUB-LINE | K2 | K1 | B | R | K2 | K1 | 1/4 | |
FIG. 22C
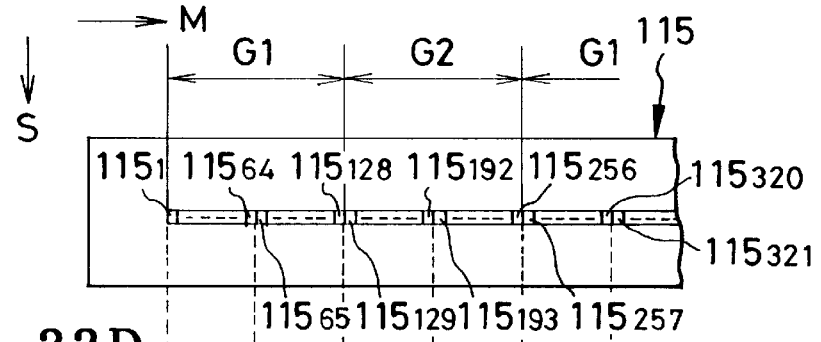
FIG. 22D
| | | | | | | | | |
|---|---|---|---|---|---|---|---|---|
| 1ST SUB-LINE | B1 | B1 | K | K | B1 | B1 | 1/4 | ONE LINE |
| 2ND SUB-LINE | B2 | B2 | R | R | B2 | B2 | 1/4 | |
| 3RD SUB-LINE | K | K | B1 | B1 | K | K | 1/4 | |
| 4TH SUB-LINE | R | R | B2 | B2 | R | R | 1/4 | |
| 1ST SUB-LINE | B1 | B1 | K | K | B1 | B1 | 1/4 | ONE LINE |
| 2ND SUB-LINE | B2 | B2 | R | R | B2 | B2 | 1/4 | |
| 3RD SUB-LINE | K | K | B1 | B1 | K | K | 1/4 | |

THERMAL PRINTING METHOD AND APPARATUS HAVING GROUPS OF SEPARATELY DRIVE HEATING ELEMENTS IN THE THERMAL HEAD

BACKGROUND OF THE INVENTION

1. Field of the Invention

The present invention relates to a thermal printing method and a thermal printer. More particularly, the present invention relates to a thermal printing method and a thermal printer with high fidelity in gradation reproduction of an image.

2. Description Related to the Prior Art

There are plural types of thermal printers, including a thermal transfer type and a direct thermal recording type. The thermal transfer type is either a wax-transfer type or a thermal sublimation type. Ink film is superposed on a recording material or a sheet. A thermal head presses the ink film against the recording material and applies heat to it, so that the ink of the ink film is transferred to the recording material. In the direct thermal recording type, the recording material with a thermosensitive characteristic is heated by the thermal head to develop color of the recording material with an image. The thermal head is constituted by an array of heating elements, which respectively consist of a resistor and are arranged in line. The heating elements are driven by a driver.

In the thermal recording with the thermal head including the heating elements being numerous, a peak voltage of a power source increases considerably when all the heating elements are driven simultaneously. Such an increase in the voltage causes an instantaneous drop in the voltage, and thus irregularity in a reproduced image.

There is a suggestion of decreasing the number of the heating elements being driven simultaneously. The heating elements are grouped into plural groups. Starts of applying heat from the heating elements are set different between the groups. JP-A 3-39262 discloses an idea in which the time of applying heat to the heating elements is divided to plural sections, and the sections are changed over between the respective groups for application of heat energy. This is for the purpose of printing an image with a small capacity of the power source. The heating elements are alternately or cyclically driven between the groups. But the width of drive pulses is divided to plural smaller units. If the printing operation is effected at a high speed, the width of the drive pulses is decreased. Differences in the time of turning on and off the heating elements will remain in results of the printing in a form of irregularity in gradation reproducibility, which will be degraded remarkably.

SUMMARY OF THE INVENTION

In view of the foregoing problems, an object of the present invention is to provide a thermal printing method and a thermal printer with high fidelity in gradation reproduction of an image without irregularity in density.

Another object of the present invention is to provide a thermal printing method and a thermal printer in which occurrence of irregularity in the feeding speed and the density is prevented by reducing changes in the friction coefficient between the recording material and the heating elements.

In order to achieve the above and other objects and advantages of this invention, a thermal head has plural heating elements arranged in line in a main scan direction, the heating elements are supplied with at least one drive pulse while the thermosensitive recording material is conveyed in a sub scan direction crosswise to the main scan direction, for thermal recording to the recording material by one line. The heating elements are grouped into first and second groups. The drive pulse for the first group of the heating elements is determined by starting the drive pulse at a start of the one line. The drive pulse for the second group of the heating elements is determined by ending the drive pulse at an end of the one line.

In a preferred embodiment, the heating elements are arranged cyclically in the main scan direction in relation to the first and second groups.

The heating elements are arranged cyclically by repetition of a predetermined arranging pattern, the arranging pattern is constituted by n of the heating elements included in the first group, and n of the heating elements disposed adjacent thereto and included in the second group, and $n \geqq 1$.

A number of heating elements included in the first group among the heating elements is substantially equal to a number of heating elements included in the second group among the heating elements.

Furthermore, first comparison data is generated for the first group of the heating elements, the first comparison data being predetermined to step up serially from a minimum. Second comparison data is generated for the second group of the heating elements, the second comparison data being predetermined to step down serially from a maximum. The at least one drive pulse comprises plural drive pulses. The first and second comparison data are compared with heating-element drive data of the one line, the heating-element drive data being determined in accordance with image data, so as to generate a train of the drive pulses.

Consequently the thermal printing method and thermal printer can have high fidelity in gradation reproduction of an image without irregularity in density.

In another preferred embodiment, the thermal head is supplied with at least one bias pulse and at least one image pulse, for thermal recording to the recording material by one line, the bias pulse applies bias heat energy directly short of coloring the coloring layer, and the image pulse applies image heat energy in accordance with coloring density. To drive the thermal head, the heating elements are grouped into first to Nth groups, where $N \geqq 2$. First to Nth sub-line recording periods are set by dividing N into a line recording period adapted for recording of the one line. During a Kth of the sub-line recording periods, the bias pulse is applied to the heating elements of a Kth of the first to Nth groups, so as to apply the bias heat energy in the thermal head during any of the first to Nth sub-line recording periods. Directly before or directly after the Kth sub-line recording period and during the first to Nth sub-line recording periods, the image pulse is applied to the heating elements of the Kth group.

The heating elements are arranged cyclically in the main scan direction in relation to the first to Nth groups.

Consequently, an occurrence of irregularity in the feeding speed and the density is prevented by reducing changes in the friction coefficient between the recording material and the heating elements.

Moreover, the heating elements are arranged cyclically by repetition of a predetermined arranging pattern, the arranging pattern is constituted by n of the heating elements included in a Kth of the first to Nth groups, and n of the heating elements disposed adjacent thereto and included in a (K+1)th of the first to Nth groups, and $n \geqq 1$.

Numbers of heating elements included in the first to Nth groups among the heating elements are substantially equal.

The thermal head is used with plural driver ICs, each one of the driver ICs is connected with a of the heating elements, for driving the a heating elements, and the a heating elements are included in one of the first to Nth groups.

The at least one coloring layer comprises first to third coloring layers arranged in sequence from a recording surface of the recording material, the first to third coloring layers are colorable respectively in first to third colors, and the first to third colors include yellow, magenta and cyan. The heating elements are arranged cyclically by repetition of a predetermined arranging pattern, the arranging pattern is predetermined by arranging at least N of the heating elements, and the at least N heating elements are respectively associated with the first to Nth groups. The arranging pattern is different between the first to third colors.

N=N1 for the first color, N=N2 for the second color, and N=N3 for the third color, and N3<N1.

As an example of the preferred embodiment, the heating elements are grouped into first to fourth groups, the heating elements being arranged cyclically in the main scan direction in relation to the first to fourth groups. First to fourth sub-line recording periods are set by dividing four into a line recording period adapted for recording of the one line. The image pulse is separated into first and second partial image pulses. During a Kth of the sub-line recording periods, the bias pulse is applied to the heating elements of a Kth of the groups, so as to apply the bias heat energy in the thermal head during any of the first to fourth sub-line recording periods. During a (K+1)th or (K−3)th of the sub-line recording periods, the first partial image pulse is applied to the heating elements of the Kth group. During a (K+2)th or (K−2)th of the sub-line recording periods, the second partial image pulse is applied to the heating elements of the Kth group. During a (K+3)th or (K−1)th of the sub-line recording periods, the heating elements of the Kth group are stopped to keep a cooling state.

When a pixel to be recorded with the image pulse has a maximum density, the image pulse has a maximum time width, and the maximum time width is a sum of lengths of two of the sub-line recording periods. In the separating step, if a time width of the image pulse is equal to or less than a respective length of the sub-line recording periods, the first partial image pulse is generated with the time width of the image pulse. If the time width of the image pulse is equal to or more than the respective length of the sub-line recording periods, the first partial image pulse is generated with the respective length of the sub-line recording periods. Also, a difference is determined between the time width of the image pulse and the respective length of the sub-line recording periods, to generate the second partial image pulse with a time width of the difference.

In a further preferred embodiment, the heating elements are grouped into first to Pth groups for thermal recording of the first color, where $P \geqq 5$, and the heating elements being arranged cyclically in the main scan direction in relation to the first to Pth groups. First to Pth sub-line recording periods are set by dividing P into a line recording period adapted for record of the one line of the first color. The first-color image pulse is separated into first to (P−2)th partial image pulses. During a Kth of the sub-line recording periods of the first color, the first-color bias pulse is applied to the heating elements of a Kth of the groups, so as to apply the bias heat energy of the first color in the thermal head during any of the first to Pth sub-line recording periods of the first color. During a (K+X)th or {K−(P−X)}th of the sub-line recording periods of the first color, an Xth of the partial image pulses is applied to the heating elements of the Kth group, where $1 \leqq X \leqq P-2$. During a {(K+(P−1)}th or (K−1)th of the sub-line recording periods of the first color, the heating elements of the Kth group are stopped to keep a cooling state. The heating elements are grouped into first to Qth sets for thermal recording of the second color, where Q<P, and the heating elements being arranged cyclically in the main scan direction in relation to the first to Qth sets. First to Qth sub-line recording periods are set by dividing Q into a line recording period adapted for record of the one line of the second color. During an Mth of the sub-line recording periods of the second color, the second-color bias pulse is applied to the heating elements of an Mth of the sets, so as to apply the bias heat energy of the second color in the thermal head during any of the first to Qth sub-line recording periods of the second color. Directly before or directly after the Mth sub-line recording period and during the first to Qth sub-line recording periods of the second color, the second-color image pulse is applied to the heating elements of the Mth set. The heating elements is grouped into first to Rth combinations for thermal recording of the third color, where $R \leqq Q$, and the heating elements being arranged cyclically in the main scan direction in relation to the first to Rth combinations. First to Rth sub-line recording periods are set by dividing R into a line recording period adapted for record of the one line of the third color. During an Nth of the sub-line recording periods of the third color, the third-color bias pulse is applied to the heating elements of an Nth of the combinations, so as to apply the bias heat energy of the third color in the thermal head during any of the first to Rth sub-line recording periods of the third color. Directly before or directly after the Nth sub-line recording period and during the first to Rth sub-line recording periods of the third color, the third-color image pulse is applied to the heating elements of the Nth combination.

BRIEF DESCRIPTION OF THE DRAWINGS

The above objects and advantages of the present invention will become more apparent from the following detailed description when read in connection with the accompanying drawings, in which:

FIG. 10A is an explanatory view in plan, illustrating the thermal head;

FIG. 10B is an explanatory view illustrating operation of recording yellow sub-lines with grouped heating elements;

FIG. 10C is an explanatory view illustrating operation of recording magenta sub-lines with the grouped heating elements;

FIG. 10D is an explanatory view illustrating operation of recording cyan sub-lines with the heating elements;

FIG. 15A is an explanatory view in plan, illustrating the thermal head;

FIGS. 15B, 15C and 15D are explanatory views illustrating operations of respectively recording yellow, magenta and cyan sub-lines with the grouped heating elements of still another preferred thermal printer;

FIGS. 19A, 19B and 19C are explanatory views illustrating operations of respectively recording yellow, magenta and cyan sub-lines with grouped heating elements of a further preferred thermal printer;

FIG. 21A is an explanatory view in plan, illustrating the thermal head of FIG. 20;

FIGS. 21B, 21C and 21D are explanatory views illustrating operations of respectively recording yellow, magenta and cyan sub-lines with the grouped heating elements of FIG. 20;

FIG. 22A is an explanatory view in plan, illustrating the thermal head;

FIG. 22B is an explanatory view illustrating operation of recording yellow sub-lines with the grouped heating elements;

FIG. 22C is an explanatory view in plan, illustrating the thermal head;

FIG. 22D is an explanatory view illustrating operations of recording magenta and cyan sub-lines with the grouped heating elements;

DETAILED DESCRIPTION OF THE PREFERRED EMBODIMENTS OF THE PRESENT INVENTION

Figure 1:
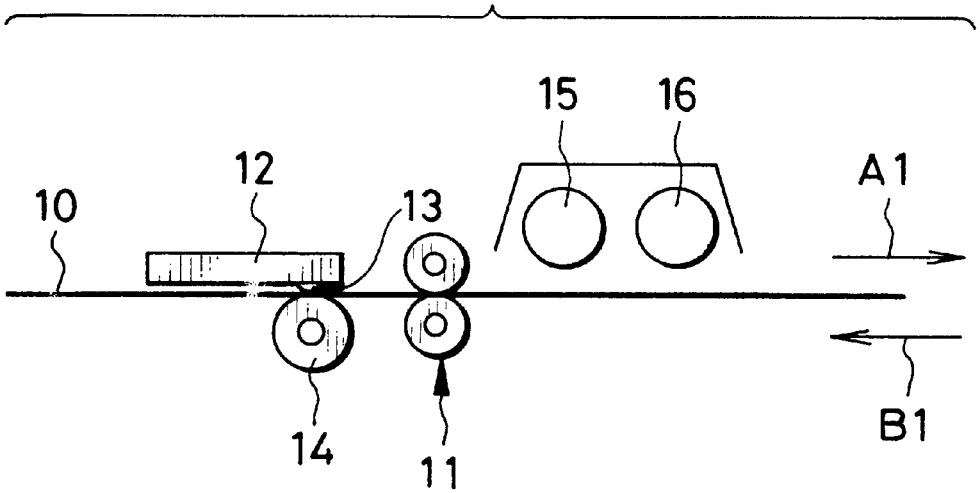
FIG. 1 is an explanatory view in elevation, illustrating a color thermal printer.

In FIG. 1, a color thermal printer is illustrated. A color thermosensitive recording material or recording sheet 10 (hereinafter referred to simply as recording material) is conveyed back and forth by a pair of feeder rollers 11, namely in a print direction A1 and a return direction B1. The recording material 10, as well-known in the art (see FIG. 8 for a typical recording material 110), is constituted by a support 105, a cyan thermosensitive coloring layer 106, a magenta thermosensitive coloring layer 107, a yellow thermosensitive coloring layer 108 and a protective layer 109 in the order listed. The magenta coloring layer 107 has optical fixability to ultraviolet rays of a wavelength peaking at 365 nm. The yellow coloring layer 108 has optical fixability to ultraviolet rays of a wavelength peaking at 420 nm.

The feeder rollers 11 convey the recording material 10 back and forth. While the feeder rollers 11 convey the recording material 10 in the print direction for a first time, a thermal head 12 records a yellow image to the recording material 10. In the conveyance for a second time, a magenta image is recorded. In the conveyance for a third time, a cyan image is recorded. Three-color frame-sequential recording is effected to record a full-color image. The bottom of the thermal head 12 has heating element array 13. There is a platen roller 14 for pressing the recording material 10 against the heating element array 13.

Figure 2:
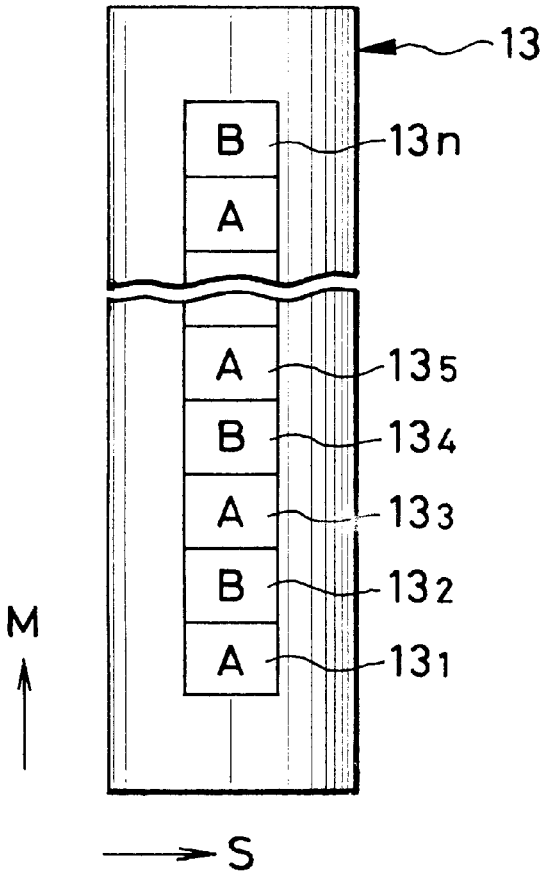
FIG. 2 is an explanatory view in plan, illustrating a thermal head of the thermal printer.

In FIG. 2, the heating element array 13 is constituted by heating elements $\mathbf{13}_1$–$\mathbf{13}_n$ arranged in line in a main scan direction. Each of the heating elements $\mathbf{13}_1$–$\mathbf{13}_n$ is a resistor element, and provides the recording material 10 with bias heat energy and image heat energy. The bias heat energy is applied to the recording material 10 to heat a pixel up to a state of the start of the color development. The image heat energy is determined in accordance with coloring density.

On the downstream side from the feeder rollers 11, there are a yellow fixer lamp 15 and a magenta fixer lamp 16 arranged on a printing path. The yellow fixer lamp 15 emanates near ultraviolet rays or visible violet rays having a wavelength range peaking at 420 nm. The magenta fixer lamp 16 emanates ultraviolet rays having a wavelength range peaking at 356 nm. At the time of the yellow recording, the yellow fixer lamp 15 is turned on to fix the yellow coloring layer after being colored. At the time of the magenta recording, the magenta fixer lamp 16 is turned on to fix the magenta coloring layer after being colored. Before the cyan recording, the initial two coloring layers are fixed. A full-color image is recorded to the recording material 10 without mixture of the three colors.

Figure 3:
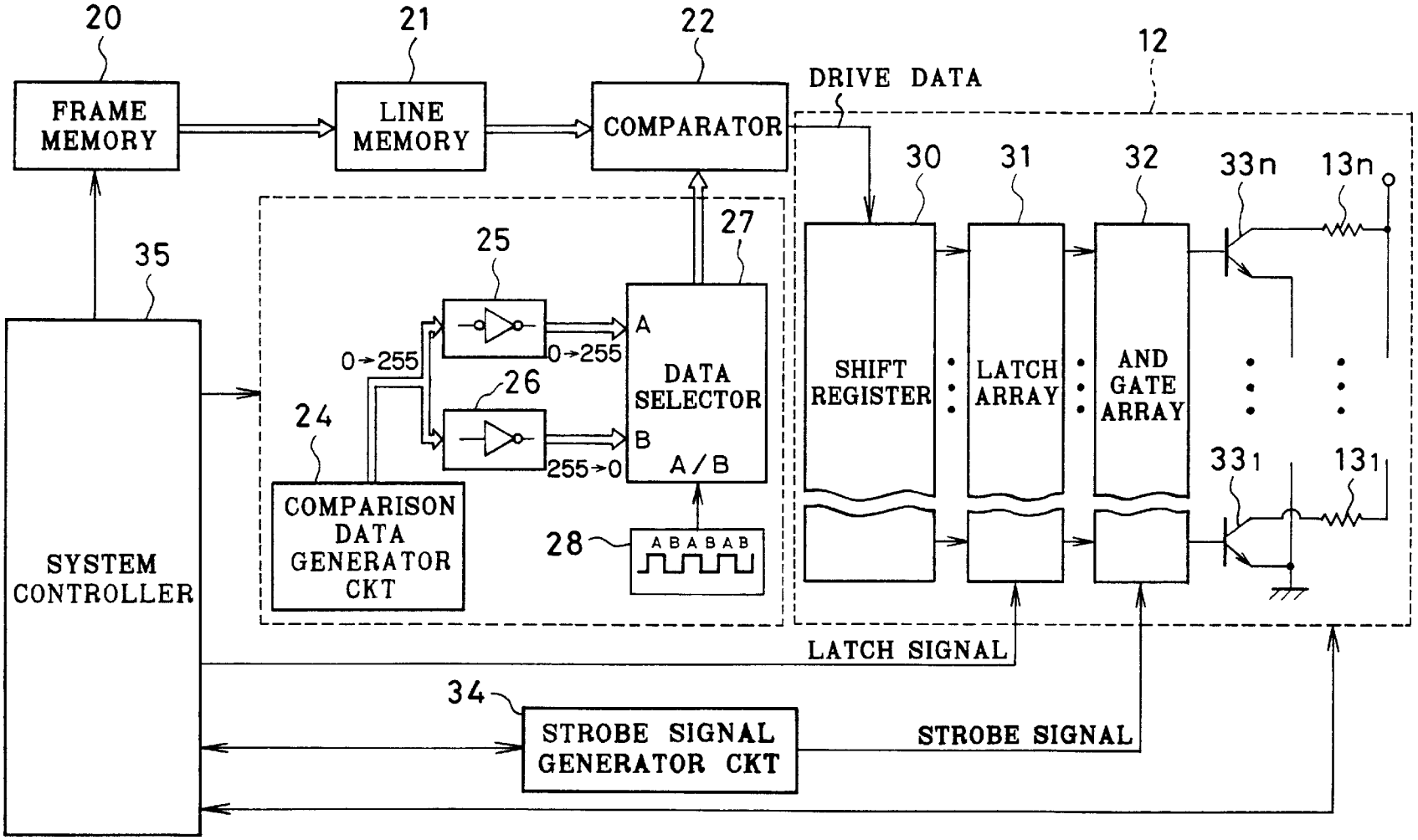
FIG. 3 is a block diagram schematically illustrating circuits of the thermal printer.

In FIG. 3, electrical circuits of the color thermal printer are depicted. A frame memory 20 stores heating-element drive data in a state separate between the three colors. The heating-element drive data is constituted by number data of drive pulses for the heating elements $\mathbf{13}_1$–$\mathbf{13}_n$, and determined as a sum of addition of bias pulse number data and image pulse number data. The bias pulse number data is to generate the bias heat energy. The image pulse number data is to generate the image heat energy. The bias pulse number data is predetermined in consideration of coloring characteristics of the respective coloring layers. The image pulse number data obtained in accordance with image data. The image data is obtained by an input device, for example an electronic still camera. The image data is related to a level of gradation, and used in obtaining the image pulse number data, which represents density of a dot to be recorded in the pixel.

There is a line memory 21, to which the heating-element drive data is written by one line for the color to be printed, in accordance with the data read from the frame memory 20. The heating-element drive data of the one line is read from the line memory 21 for 256 times, and sent to a comparator 22.

Figures 4A, 4B:
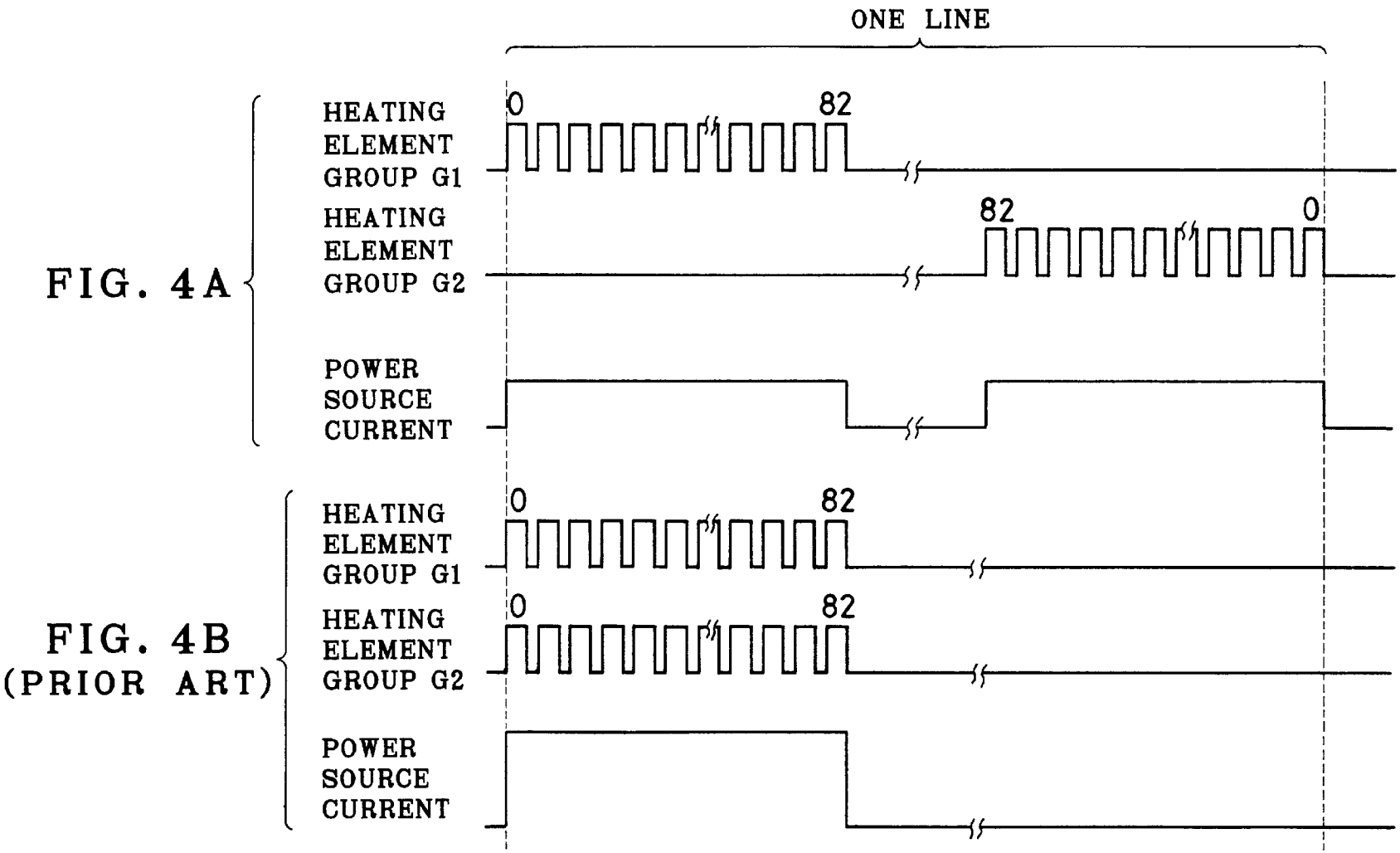
FIG. 4B (PRIOR ART)
FIG. 4A is a timing chart illustrating operation of the thermal head.
FIG. 4B is a timing chart illustrating operation of a thermal head in the prior art.

The comparator 22 compares the one-line heating-element drive data with comparison data for the respective colors for 256 times. The comparison data is generated by a comparison data generator 23. If the comparison data is simply 0–255 in series, and compared with the heating-element drive data, all the heating elements $\mathbf{13}_1$–$\mathbf{13}_n$ are driven at the same time. As depicted in FIG. 4B for the prior art, the current of the power source is the sum of currents flowing in the heating elements $\mathbf{13}_1$–$\mathbf{13}_n$, and will have a considerably high peak.

To solve this problem, the heating elements in the present invention are grouped into two groups G1 and G2 of FIG. 2, in a manner alternate by one element in the main scan direction. In the drawing, the heating elements are designated with a sign A for group G1 and a sign B for group G2. The comparison data is generated in the increasing order of 0–255 for group G1, and in the decreasing order of 255–0 for group G2.

In FIG. 3, the comparison data generator 23 includes a comparison data generator circuit 24, a non-inverter 25, an inverter 26 and a data selector 27. The comparison data generator circuit 24 generates the comparison data of 0–255 in series. The comparison data is sent to the data selector 27 via the non-inverter 25 and the inverter 26. The non-inverter 25 outputs the comparison data of 0–255 without changes. The inverter 26 inverts the comparison data of 0–255 into data from 255 down to zero (0).

To be precise, the comparison data generator circuit 24 generates the comparison data of 0–255 in a binary form with 8 digits, namely "0000 0000" to "1111 1111". The inverter 26, when receiving the data from the comparison data generator circuit 24, inverts the respective 8 digits from 0 to 1 or from 1 to 0, to obtain the comparison data of "1111 1111" down to "0000 0000".

The data selector 27 selects one kind of the comparison data for each of the groups, and sends it to the comparator 22. The data selector 27 selects the output of the non-inverter 25 for group G1, and the output of the inverter 26 for group G2. There is a select signal generator circuit 28, which supplies the data selector 27 with a select signal for the data selector 27 to select one of the two kinds of the comparison data.

The select signal has either level of H (High) and L (Low). The H (High) level is associated with the heating elements of group G1. The L (Low) level is associated with the heating elements of group G2. In the present embodiment, the heating elements of groups G1 and G2 are arranged alternately one by one. Accordingly the select signal is a pulse train of H-L-H-L- . . . The select signal is input to the data selector 27 at the time suitably determined with the comparison operation of the comparator 22. When the select signal is H (High), the data selector 27 selects the output of the non-inverter 25. When the select signal is L (Low), the data selector 27 selects the output of the inverter 26.

In FIG. 4A, the heating elements $\mathbf{13}_1$, $\mathbf{13}_3$, $\mathbf{13}_5$ and so on included in group G1 are driven to start applying heat at a beginning position of one line with reference to the print direction of the recording material. The heating elements $\mathbf{13}_2$, $\mathbf{13}_4$ and so on included in group G2 are driven to finish applying heat at an ending position of one line with reference to the print direction of the recording material. The drive current supplied to the heating elements is divided into two between groups G1 and G2 in the recording of pixels of a low density for which the number of drive pulses is 122 or less. It is possible to reduce the peak of the drive current to a half of that of the prior art. Note that, in FIGS. 4A and 4B, one line is recorded at the same density between groups G1 and G2 of the heating elements, for example with drive data to generate 82 drive pulses. In spite of the depicted pulse trains, the respective heating elements are driven by drive pulses in the numbers individually determined according to image data of one of various images. In the recording of the high density, the period of heating of group G2 overlaps on the period of heating of group G1. The peak of the drive current is reduced to a slightly smaller amount than that of the prior art.

In FIG. 3, the comparator 22 compares the heating-element drive data with the comparison data. If the comparison data is smaller, the comparator 22 outputs the drive data at the H (High) level. If not, the comparator 22 outputs the drive data at the L (Low) level. For example, the comparison data of zero (0) is generated for the heating elements of group G1. The comparison data of 255 is generated for the heating elements of group G2. With the comparison data of those values, operation of comparison is made serially to the heating-element drive data of one line. A result of the comparison of the one line is sent by the comparator 22 to a shift register 30 as a serial signal. When the comparison is finished with the heating-element drive data of the one line, the comparison data generator 23 sends the comparator 22 next comparison data, one (1) for group G1, and 254 for group G2. The comparator 22 compares the heating-element drive data of the one line with the comparison data. Similarly comparison with the comparison data stepped up or down is made one after another. The heating-element drive data is compared for 256 times, and thus is converted into drive data of 256 bits. The drive data is sent to the shift register 30 one bit after another.

The drive data in the serial form is shifted in the shift register 30 and converted into a parallel form. The drive data in the parallel form is latched by a latch array 31 in synchronism with a LATCH signal. An AND gate array 32 outputs a signal at the H (High) level if the drive data is the H (High) level while the AND gate array 32 receives the STROBE signal.

Transistors $\mathbf{33}_1$–$\mathbf{33}_n$ are connected to respective outputs of the AND gate array 32. When each of the outputs of the AND gate array 32 is H (High), the transistors $\mathbf{33}_1$–$\mathbf{33}_n$ are turned on. The heating elements $\mathbf{13}_1$–$\mathbf{13}_n$ are connected with the transistors $\mathbf{33}_1$–$\mathbf{33}_n$ respectively in a serial manner.

A strobe signal generator circuit 34 is controlled by a system controller 35, and generates a STROBE signal for determining the time of turning on and off the heating elements $\mathbf{13}_1$–$\mathbf{13}_n$. The STROBE signal has a pulse width differently determined between the colors to be printed. Preset data of the STROBE signal is predetermined for the three colors, and stored. The system controller 35 consists of a microcomputer, and controls the various circuits for the printing operation.

The operation of the above embodiment is described now. When a print start switch (not shown) is turned on, the system controller 35 operates for feeding of the recording material 10. Upon the finish of feeding of the recording material 10, the feeder rollers 11 convey the recording material 10 in the print direction. When a starting end of a recording area of the recording material 10 reaches the heating element array 13, a first line of the yellow color starts being colored in the thermal recording. The heating-element drive data of the first line, which is stored in the frame memory 20, is written to the line memory 21. The heating-element drive data is then sent from the line memory 21 to the comparator 22. The comparison data generator 23 generates the two kinds of the comparison data different between groups G1 and G2 of the heating elements $\mathbf{13}_1$–$\mathbf{13}_n$, and sends them to the comparator 22.

The comparator 22 compares the heating-element drive data for the yellow recording from the line memory 21 with the comparison data from the comparison data generator 23. If the comparison data is smaller than the heating-element drive data, the comparator 22 outputs the drive data of the H (High) level. The drive data in the serial form for the one line is sent from the comparator 22 to the shift register 30, which shifts the drive data and converts it into the parallel form. The latch array 31 latches the drive data of the parallel form, which is sent to the AND gate array 32. The AND gate array 32 is supplied with the STROBE signal by the strobe signal generator circuit 34 in synchronism with the latch operation. When the drive data is H (High) and also when the STROBE signal is generated, then the AND gate array 32 outputs at the H (High) level. The transistor $\mathbf{33}_1$ is turned on. A drive pulse, having a width according to the STROBE signal, is sent to the heating element $\mathbf{13}_1$, so that the heating element $\mathbf{13}_1$ emits heat. Similarly the comparison data is used in comparison operation. According to results of the comparison, the heating elements $\mathbf{13}_1$–$\mathbf{13}_n$ are driven. The heating elements $\mathbf{13}_1$–$\mathbf{13}_n$ are caused to emit heat according to density represented by the image data, to record one dot.

Similarly succeeding lines of the yellow color are recorded thermally. Upon recording of the yellow color, the yellow fixer lamp 15 is turned on to fix the yellow coloring layer being colored. Upon the finish of the yellow recording, the feeder rollers 11 are rotated in reverse to convey back the recording material 10. Then the magenta color is thermally recorded to the magenta coloring layer in the recording area. Upon recording of the magenta color, the magenta fixer lamp 16 is turned on to fix the magenta coloring layer being colored. Upon the finish of the magenta recording, the feeder rollers 11 are rotated in reverse to convey back the recording material 10. Then the cyan color is recorded. Also during the cyan recording, the magenta fixer lamp 16 is kept turned on to bleach unrecorded areas about the recording area. Thus the three-color frame-sequential recording is finished to record a full-color image to the recording material 10.

In the above embodiments, the heating elements $\mathbf{13}_1$–$\mathbf{13}_n$ are grouped into groups GI and G2 in an alternate manner one by one. Of course the heating elements $\mathbf{13}_1$–$\mathbf{13}_n$ can be grouped into two groups in an alternate manner at every two elements, or every three or more elements. For example, the heating element array 13 may be constituted by two sections, including a first group disposed in a range from the center to the left end, and a second group disposed in a range from the center to the right end.

Moreover, the heating elements can be arranged periodically in repetition of a predetermined arranging pattern regarding two groups G1 and G2. Such a predetermined arranging pattern may be preset in any suitable manner. For example, the heating elements may be arranged in repetition of the pattern of A-A-B-A-B-B where sign A designates group G1 and the sign B designates group G2.

Figure 5:
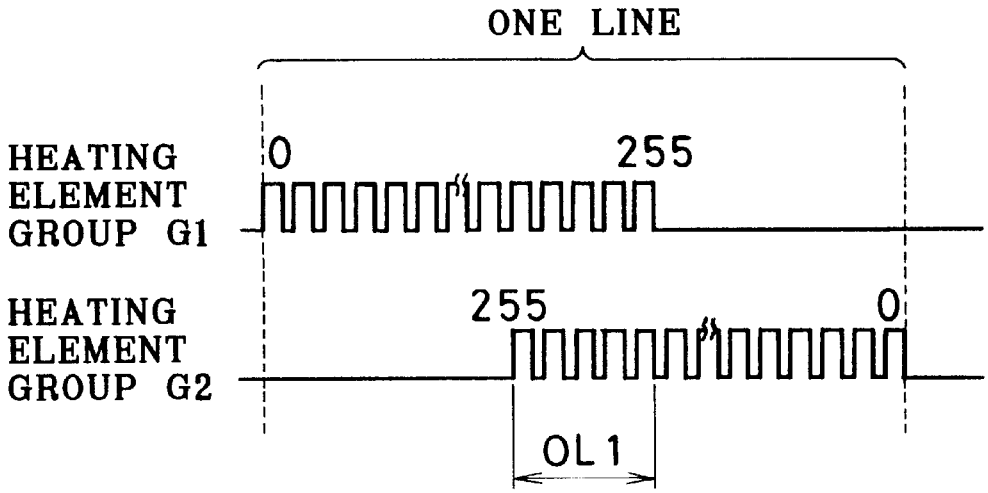
FIGS. 5 and 6 are timing charts illustrating operation of a thermal head in other preferred embodiments.
Figure 6:
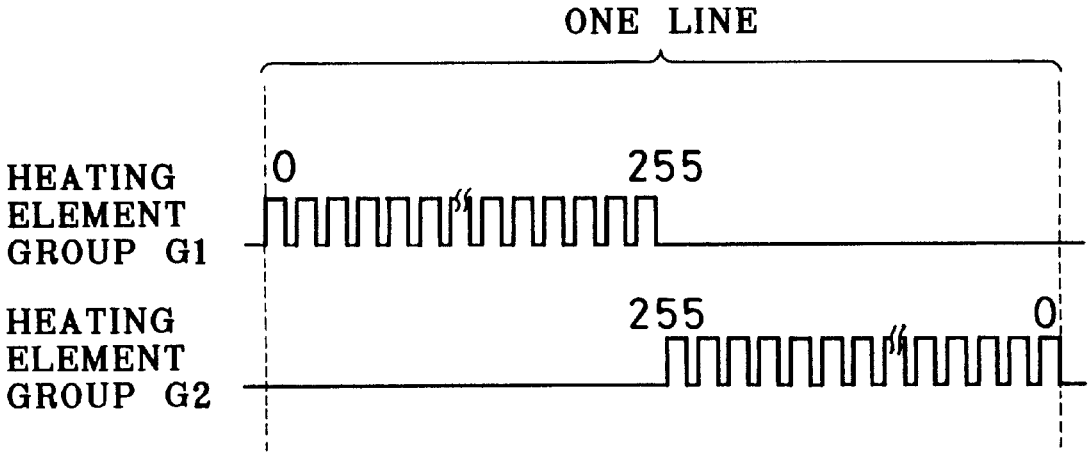

In the above embodiment, the heating-element drive data, when having a value to record the maximum density, is the same between groups G1 and G2, as the drive pulse number is 255. This is effective to shorten the time required for printing. In other words, time taken to generate a train of drive pulses, when a pixel is to be recorded by them has the maximum density, is equal to a line recording period. Alternatively the heating-element drive data for the group G1 to record the maximum density may be overlapped on the heating-element drive data for the group G2 to record the maximum density. See FIG. 5. An amount OL1 of the overlap may be changed in any suitable manner. Furthermore it is possible to eliminate the overlap between the two kinds of the heating-element drive data. See FIG. 6. In other words, a drive pulse train for group G2 can be generated exclusively after the end of generation of a drive pulse train for group G1. The embodiments of FIGS. 5 and 6 have a prolonged time required for printing, due to smallness of the overlapped amount OL1. However they are effective in shortening time during which the power source current has a peak in the printing operation.

In the above embodiments, a train of the heating element drive pulses includes a great number of pulses. Alternatively each heating element may be driven by one drive pulse. In the above embodiments, the heating-element drive data is written to the frame memory 20 as a sum of the bias data and the image drive data for image pulses. However two separate memories may be used for storing the bias data and the image drive data, which may be added up before being written to the line memory 21 in a successive manner.

In the above embodiments, the thermal printer is a capstan-drive type in which the feeder rollers 11 are used. Of course the present invention may be used in a platen drum type of thermal printer in which a platen drum feeds the recording material. In the above embodiments, the thermal printer is a full-color thermal printer. Of course the present invention may be used in a wax-transfer type or melt-type of thermal printer, and used in a monochromatic thermal printer. In the above embodiments, the thermal printer is a line printer. Of course the present invention may be used in a serial printer.

Referring now to FIGS. 7–22D, still other preferred embodiments are described, in which changes in the friction coefficient between the recording material and the heating elements are reduced.

Figure 23A:
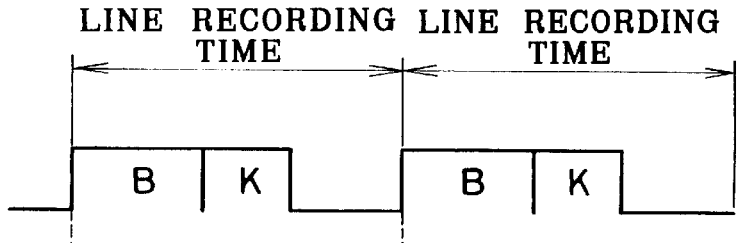
FIG. 23A (PRIOR ART)
FIG. 23A is a timing chart illustrating operation of heating elements of the prior art.

In the conventional thermal printer, all the heating elements of a thermal head arranged in a main scan direction are supplied with bias pulses B and image pulses K at the same starting time. See FIG. 23A. The bias pulses B provides each coloring layer with heat energy slightly short of color development. The image pulses K provides the heat energy for reproducing halftone or gradation at a halftone level according to the image data. The bias pulses B are a train of successive plural pulses. Or a single bias pulse of a corresponding length may be used in a continuous powering manner. The image pulses K are a train of successive plural pulses. Or else a single image pulse of a corresponding length may be used.

Figure 23B:
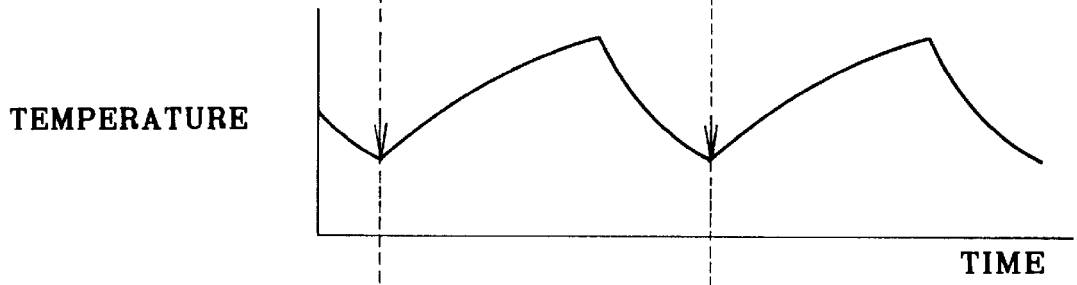
FIG. 23B (PRIOR ART)
FIGS. 23B, 23C and 23D are graphs respectively illustrating changes in temperature of the thermal head with time, changes in a friction coefficient of each heating element with time, and changes in a conveying speed of the recording material with time, all according to the prior art.
Figure 23C:
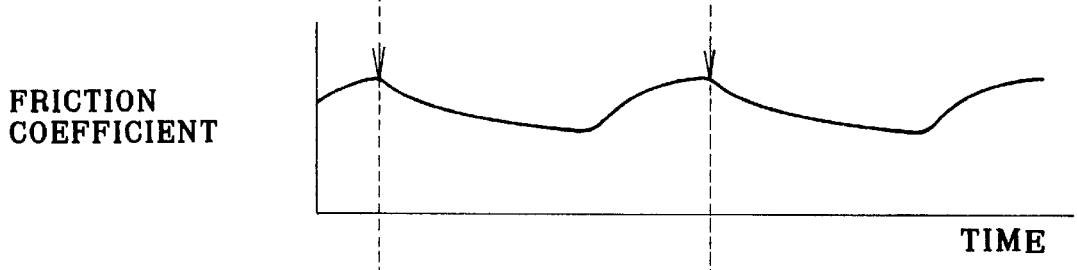
FIG. 23C (PRIOR ART)
Figure 23D:
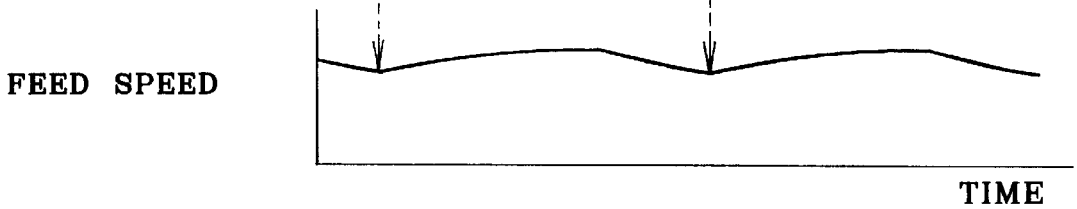
FIG. 23D (PRIOR ART)

The bias pulses are applied to all the heating elements in an equal manner. In FIG. 23B, an average temperature of the whole of the thermal head during the record of one line is changed. A width of the change in the average temperature is likely to increase. Due to the changes in the temperature, a friction coefficient between the heating elements and a recording material changes. See FIG. 23C. Mechanical load to a feeder system for feeding the recording material occurs inevitably. The more the heat energy which is applied to the heating elements, the higher a temperature of the surface of the heating elements. Thus the friction coefficient becomes the smaller. In contrast, the friction coefficient becomes greater when the heat energy becomes lower. This is because the temperature of a surface coating of the recording material is increased by the pulses to change the state of the surface. Therefore the changes in the friction coefficient between the thermal head and the recording material cause changes in the force received by a system for transmitting force of conveying the recording material, a mechanism for supporting the thermal head, or other mechanical constructions. A small amount of mechanical deformation is changed in accordance with changes in the image to be recorded. The changes in the deformation results in changes in a feeding amount of the recording material. In FIG. 23D, the feeding speed changes. The heat energy applied per unit area of the recording material is changed due to the changes in the feeding amount. Hence irregularity in density occurs.

There is a suggestion of reducing the number of simultaneously driven heating elements for the purpose of spreading distribution of heat. For example JP-A 63-275268 discloses a thermal printer in which the heating elements being arranged linearly is grouped into plural groups. In each of the groups, the heating elements are thinned at a constant interval. The heating elements are driven in different time zones between the plural groups. In this printer, the distribution of the temperature in the thermal head in the main scan direction can be rendered uniform as compared with still earlier printers in which the heating elements are grouped from the center into two groups, right and left. It is possible to eliminate differences in coloring density due to differences in the temperature. However there is no consideration of uniforming the distribution of the temperature in a sub scan direction. A problem remains in that differences in coloring density cannot be efficiently eliminated in the sub scan direction inside one line in comparison with differences in the main scan direction. While a portion of low density is printed, there occurs a section or period in which all the heating elements are stopped and cooled. It is likely that the temperature changes in the sub scan direction inside the one line.

JP-A 6-270454 discloses a thermal printing method of an area halftone type. Adjacent pixels are offset by a common amount, for example by an amount of a ⅛ pixel, for the purpose of suppressing occurrence of streaks or line-shaped noises in the main scan direction due to the adjacent arrangement of the pixels. However the same problem as JP-A 63-275268 remains. While a portion of low density is printed, there occurs a section or period in which all the heating elements are stopped and cooled. It is likely that the temperature changes in the sub scan direction inside the one line.

In view of those situations, still another preferred embodiment is described now, in which changes in the temperature in the sub scan direction inside one line are suppressed, changes in the friction coefficient between the recording material and the heating elements are reduced, and occurrence of irregularity in the feeding speed and the density is prevented.

Figure 7:
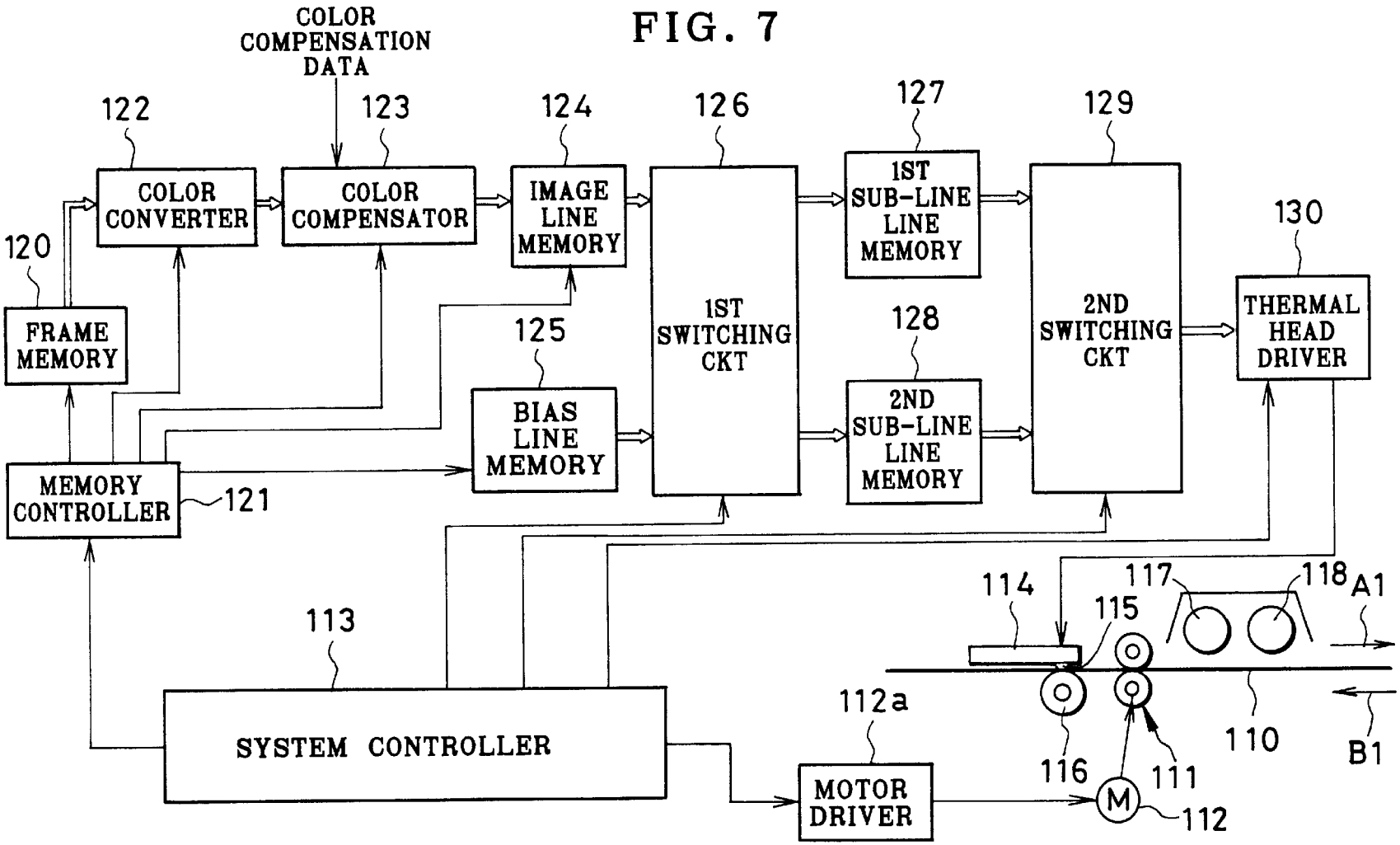
FIG. 7 is a block diagram schematically illustrating another preferred thermal printer in which each one line to be recorded is divided into plural sub-lines.

In a color thermal printer of FIG. 7, a color thermosensitive recording material or recording sheet 110 is conveyed back and forth by a pair of feeder rollers 111, namely in a print direction A1 and a return direction B1. The feeder rollers 111 are rotated by a stepping motor 112. The stepping motor 112 is controlled by a system controller 113 via a motor driver 112*a*.

Figure 8:
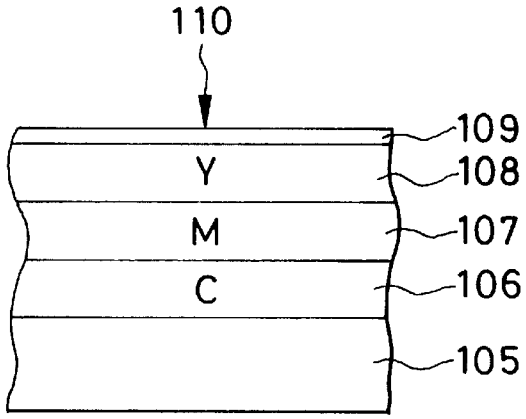
FIG. 8 is an explanatory view in section, illustrating color thermosensitive recording material.

In FIG. 8, the recording material 110 is constituted by a support 105, a cyan thermosensitive coloring layer 106, a magenta thermosensitive coloring layer 107, a yellow thermosensitive coloring layer 108 and a protective layer 109 in the order listed. The magenta coloring layer 107 has optical fixability to ultraviolet rays of a wavelength peaking at 365 nm. The yellow coloring layer 108 has optical fixability to ultraviolet or violet rays of a wavelength peaking at 420 nm. The coloring layers 106–108 are disposed in the order of being colored toward the support. In FIG. 8, signs Y, M and C respectively designate the coloring layers 106–108. Although omitted from FIG. 8, there are intermediate layers between the coloring layers 106–108 for the purpose of adjusting heat sensitivity of the magenta coloring layer 107 and the cyan coloring layer 106. The support 105 is opaque coated paper of plastic film. If the thermal printer is used to make a sheet for an overhead projector, the support 105 is transparent plastic film.

Figure 9:
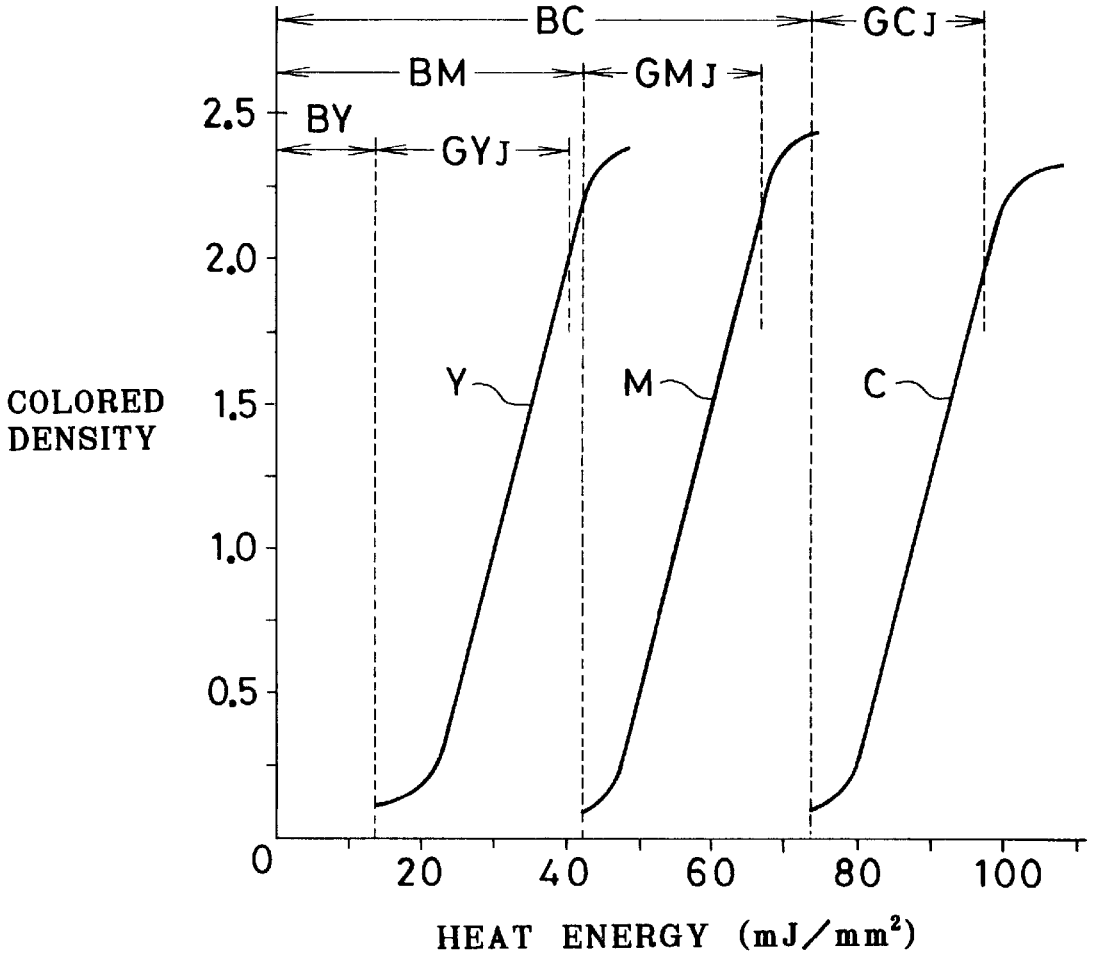
FIG. 9 is a graph illustrating coloring characteristics of the recording material.

In FIG. 9, coloring characteristics of the coloring layers are illustrated. The yellow coloring layer 108 in the recording material 110 has the highest heat sensitivity, thus is colorable with the lowest heat energy. The cyan coloring layer 106 has the lowest heat sensitivity, thus is colorable with the highest heat energy. To record a yellow (Y) pixel, coloring heat energy as a sum of bias heat energy BY and image heat energy GYJ is applied to the recording material 110. The bias heat energy BY is heat energy slightly short of heat energy sufficient for starting color development of the yellow coloring layer 108, and is applied to the recording material 110 during a bias heating period determined in the beginning of a recording period of one pixel. The image heat energy GYJ depends upon a gradation level J or coloring density of the pixel to be recorded, and is applied to the recording material 110 during a image heating period succeeding to the bias heating period. Also for magenta (M) and cyan (C) pixels, there are two kinds of heat energy.

In FIGS. 7 and 10A, reference numeral 114 designates a thermal head, 115 a heating element array, 116 a platen roller, $\mathbf{115}_1$–$\mathbf{115}_n$ heating elements, 117 a yellow fixer lamp, and 118 a magenta fixer lamp.

In FIG. 7, a frame memory 120 stores color image data including R (Red), G (Green) and B (Blue) signals in a separate manner after being written by a personal computer, a digital still camera or other external equipment (not shown). A memory controller 121 reads one-line image data from the frame memory 120, and sends it to a color converter 122. The color converter 122 converts the image data from the frame memory 120 into the image data of yellow, magenta and cyan for the purpose of coloring the coloring layers at density and color according to the initial color image data. For the yellow recording, the data conversion is made to obtain yellow image data of one line, which is sent to a color compensator 123. Note that one line includes 512 pixels.

The color compensator 123 adds the respective color image data from the color converter 122 to the color compensation data input by the system controller 113 for the purpose of color compensation. The yellow image drive data after the compensation is written to an image line memory 124. The image drive data is variable in a range of "$00_H$"–"$FF_H$" in accordance with the image data.

To a bias line memory 125, bias data of one line is written by the memory controller 121. The bias data is fixed data of $FF_H$.

Figure 11A:
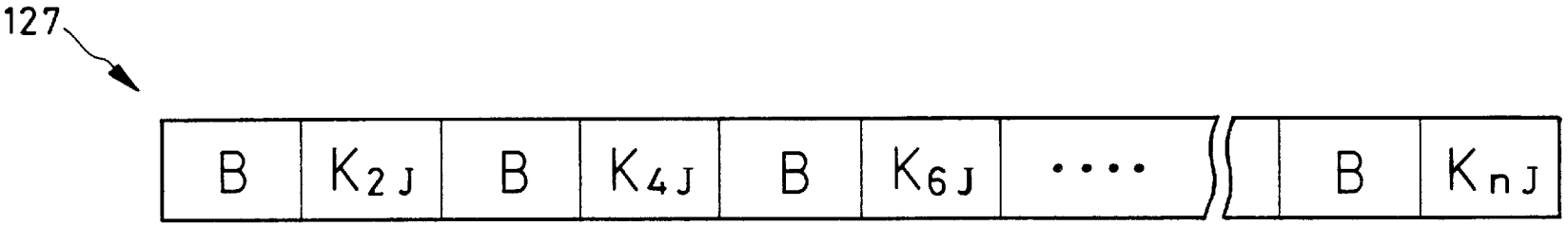
FIG. 11A is an explanatory view illustrating stored data in a first sub-line line memory.
Figure 11B:
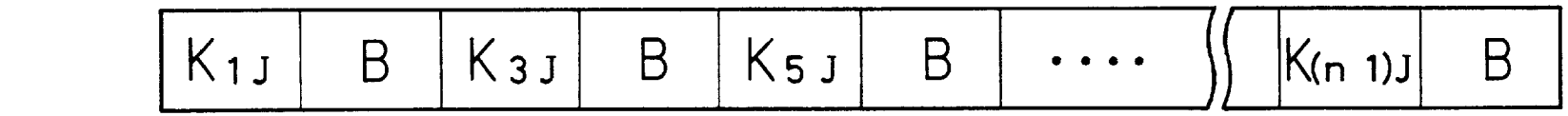
FIG. 11B is an explanatory view illustrating stored data in a second sub-line line memory.

A first switching circuit 126 reads data from the bias line memory 125 and the image line memory 124 in an alternate manner by one pixel, and writes the obtained data to first and second sub-line line memories 127 and 128. In FIG. 11A, the obtained data is written to the first sub-line line memory 127 in the order of B, $K_{2J}$, B, $K_{4J}$, B, $K_{6J}$, . . . , B, $K_{nJ}$ by following the order of the heating elements starting from the heating element $\mathbf{115}_1$. In suffixes 2J, 4J, 6J, . . . , nJ of those signs, the numbers designate the locations of the heating elements, and the sign J designates the gradation level. In FIG. 11B, the obtained data is written to the second sub-line line memory 128 in the order of $K_{1J}$, B, $K_{3J}$, B, $K_{5J}$, B, . . . , $K_{(n-1)J}$, B by following the order of the heating elements starting from the heating element $\mathbf{115}_1$. A second switching circuit 129 selects one of the sub-line line memories 127 and 128 by one sub-line which is half a line. The print data being read is sent by the second switching circuit 129 to a thermal head driver 130.

Figure 12:
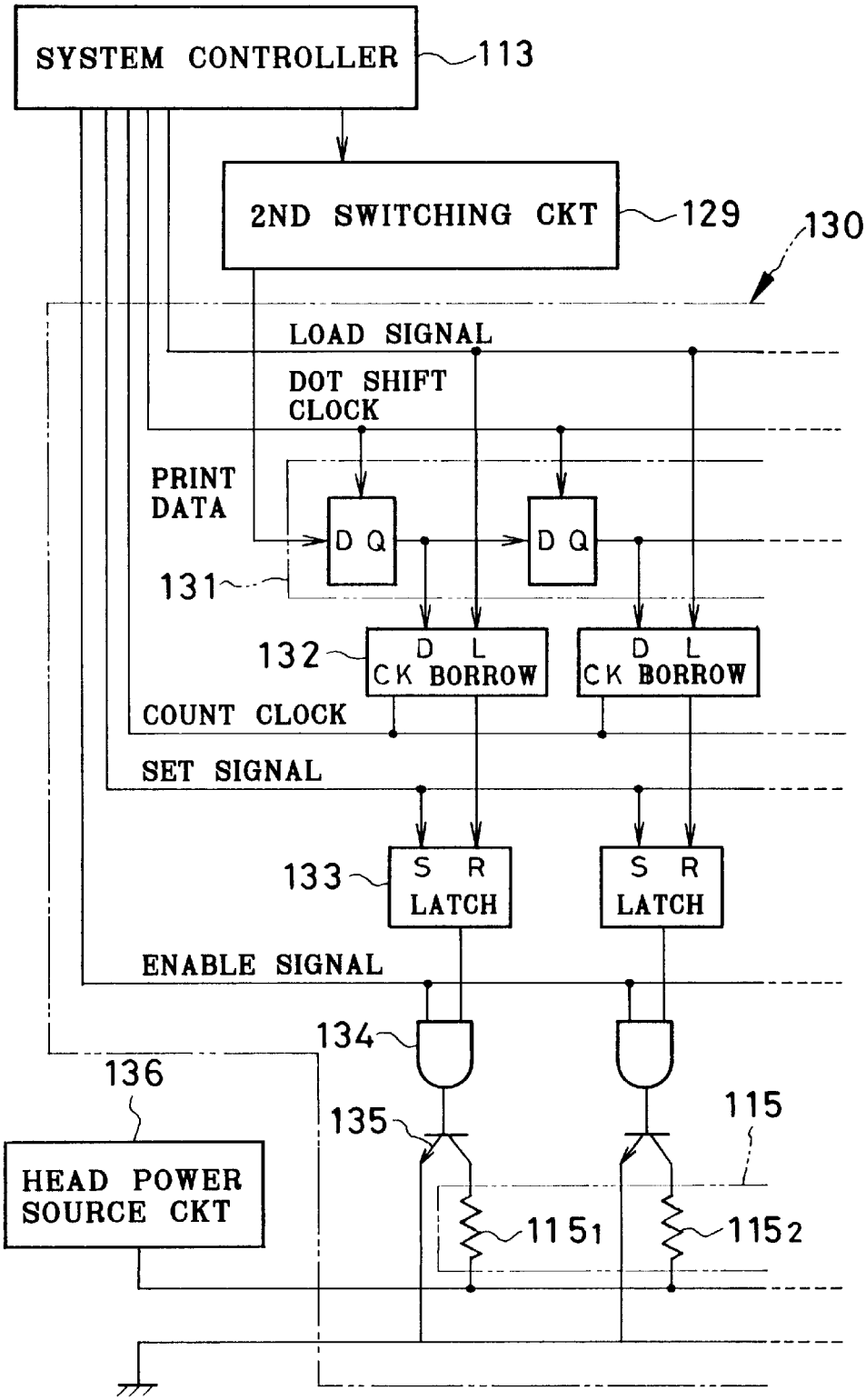
FIG. 12 is a block diagram schematically illustrating circuits including the thermal head, a heating element driver and a system controller.
Figure 13:
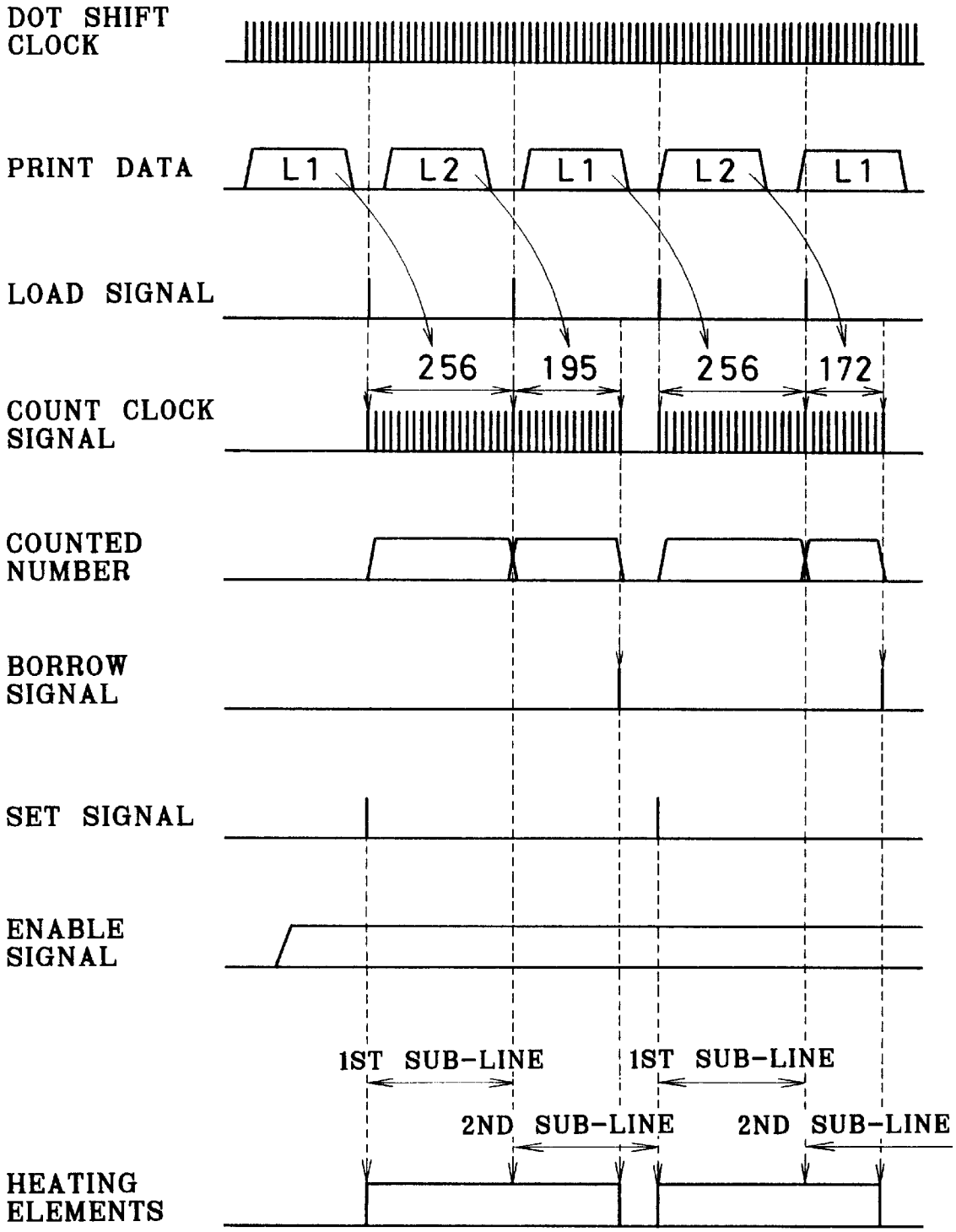
FIG. 13 is a timing chart illustrating operation of the circuits of FIG. 12.

In FIGS. 12 and 13, the thermal head driver 130 is constituted by a shift register 131, down counters 132, a latch array 133, an AND gate array 134 and transistors 135, and is mounted on a base plate of the thermal head 114. The shift register 131 shifts the 8-bit print data for one line from the second switching circuit 129 in response to a dot shift clock signal, and presets the print data in the down counters 132, which are respectively associated with the heating elements. The print data for the bias pulse is set as $FF_H$. The print data for the image pulse is variably set as $00_H$–$FF_H$ according to the initial image data. Note that, if a stop period or cooling period is additionally used, the variable data for the image pulse is set as $00_H$–$7F_H$, and the remaining data $80_H$–$FF_H$ is assigned to the cooling period.

Each of the down counters 132 counts down the count clock signal from a value preset by the shift register 131. The operation of counting down is started by a LOAD signal from the system controller 113. When the counted value becomes zero (0), a BORROW signal is output to the reset terminal of the latch array 133. If the print data $FF_H$ for the bias pulses is preset in the down counters 132, the LOAD signal is input before reach of the counted value to the zero (0). No BORROW signal is output to the reset terminal of the latch array 133. In the case of print data for image pulses, one of the values $00_H$–$FF_H$ is preset. When the counted value becomes the preset value, the BORROW signal is output to the latch array 133.

The latch array 133 receives a SET signal from the system controller 113. Each time that one line starts being recorded, the SET signal is input to a set terminal of the latch array 133. The BORROW signal is input to the reset terminal of the latch array 133. Therefore the latch array 133 sends the LATCH signal to the AND gate array 134 in a period starting upon receipt of the SET signal and ending upon receipt of the BORROW signal.

If the LATCH signal is H (High) while the system controller 113 generates the ENABLE signal, then the AND gate array 134 outputs a signal of the H (High) level. Each of outputs of the AND gate array 134 is connected with a base of an associated one of the transistors 135. When the AND gate array 134 outputs the signal of the H (High) level, the associated one of the transistors 135 is turned on. The heating elements $\mathbf{115}_1$–$\mathbf{115}_n$ are respectively connected with the transistors 135. Also the heating elements $\mathbf{115}_1$–$\mathbf{115}_n$ are connected with a head power source 136. The heating elements $\mathbf{115}_1$–$\mathbf{115}_n$ are continuously powered by the print data, to apply the bias heat energy and the image heat energy to the coloring layer. Thus a dot of the density represented by the image data is recorded to the recording material 110. FIG. 13 is a timing chart of this operation of the thermal printer with the thermal head driver 130.

The image data of the one line stored in the sub-line line memories 127 and 128 is sent to the thermal head driver 130 while selected per one sub-line. The heating elements $\mathbf{115}_1$–$\mathbf{115}_n$ are driven in a heating sequence of FIG. 10B. It is to be noted that the heating elements of the even numbers, to which the image pulse K is given in the first sub-line of the first line, do not color the recording material 110 due to the lack of preceding bias heating. However such a situation occurs only on the first of the numerous lines, and does not influence the quality of the reproduced image. It is possible to determine an additional dummy line preceding to the first line, for the purpose of applying bias heating. This enables the heating elements of the even numbers to color the recording material 110 in the first sub-line of the first line.

A heating sequence in the yellow recording is illustrated in FIG. 10B. The smallest unit pattern included in the heating sequence is indicated by the thick broken line. In the magenta recording, a heating sequence of FIG. 10C is selected. In the cyan recording, a heating sequence of FIG. 10D is selected. In the drawings, a sign B designates bias heating, and a sign K designates image heating. In the yellow recording, the heating elements associated with the odd numbers in the arrangement are driven with bias pulses B and image pulses K in the upper half of FIG. 14A. The heating elements associated with the even numbers in the arrangement are driven with image pulses K and bias pulses B in the lower half of FIG. 14A. While the first sub-line is recorded, the bias heat energy is applied to the heating elements of the group of the odd numbers. The image heat energy is applied to the heating elements of the group of the even numbers. In contrast, while the second sub-line is recorded, the image heat energy is applied to the heating elements of the group of the odd numbers. The bias heat energy is applied to the heating elements of the group of the even numbers. See FIG. 10B.

Note that, in FIG. 10D, there is no grouping of the thermal elements.

Figure 14A:
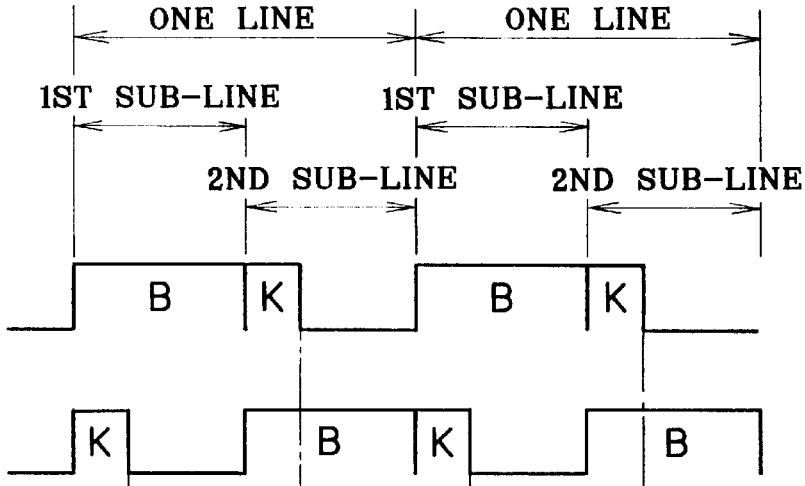
FIG. 14A is a timing chart illustrating operation of the heating elements.
Figure 14B:
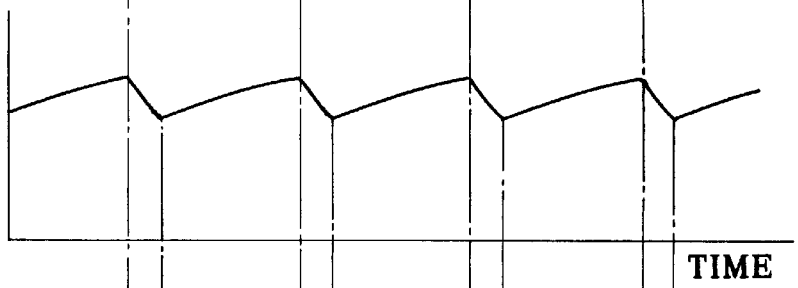
FIG. 14B is a graph illustrating a relationship between temperature of the thermal head with time.
Figure 14C:
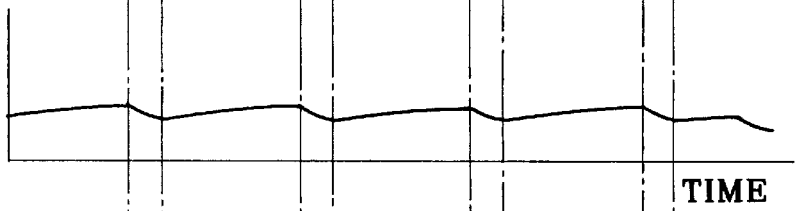
FIG. 14C is a graph illustrating a relationship between a friction coefficient of each heating element with time.
Figure 14D:
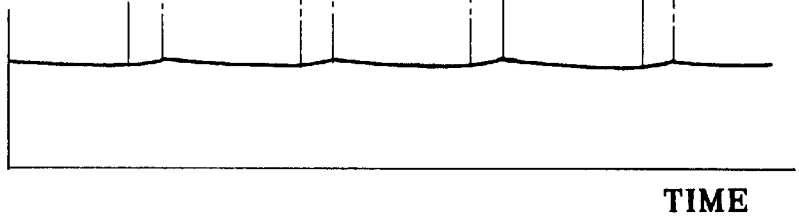
FIG. 14D is a graph illustrating a relationship between a conveying speed of the recording material with time.

This being so, either one of the two groups of the heating elements are driven for the bias heating while one line is recorded. In FIG. 14B, changes in the temperature of the heating elements in recording the one line are reduced in comparison with those of FIG. 23 in which the heating elements are simultaneously driven. In FIG. 14C, changes in the friction coefficient between the heating elements and the recording material 110 is reduced. There is a reduced change in load to the feeding. In FIG. 14D, irregularity in the conveyance is remarkably reduced. The irregularity in the density is effectively prevented.

The lack of the grouping of the thermal elements in the cyan recording of FIG. 10D is mainly based on original smallness in the irregularity in the feeding speed. The cyan recording is effected at a relatively higher temperature than for yellow or magenta. As the yellow and magenta recording has been finished to smooth the surface of the recording material 110. Accordingly all the heating elements are driven in the first sub-line for the cyan bias heating, and then driven in the second sub-line for the cyan image heating. It is still possible to use the first or second heating sequence to suppress changes in the temperature in the cyan recording of one line.

The bias heating is effected in all the sub-line recording periods. Each thermal element is driven by continuous powering with the single bias pulse. It is certain that it is impossible to compensate the bias heating for shading, for irregularity in resistance between the heating elements, or for accumulated heat, because the powering time cannot be changed for the purpose of the compensation. However a drive voltage applied for driving the thermal head 114 can be changed by the head power source 136 in accordance with compensation amounts, for adjusting heat energy applied to the recording material 110. If a train of small pulses are used for the bias heating instead of the continuous powering, it is possible not only to change the drive voltage for driving the thermal head 114, but also to change a width of the pulses of the pulse train. Furthermore, it is possible to compensate for those various factors by adjusting powering time or voltage of image heating.

Another preferred embodiment is described now, in which the heating elements are grouped into four (4). The line recording period for recording dots of one line is divided by four (4) equally to obtain first to fourth sub-line recording periods. The four sub-lines are respectively associated with application of the bias pulse, application of a first partial image pulse, application of a second partial image pulse, and stop for the cooling state. If a sub-line is subjected to the bias heating, fixed data of $FF_H$ is provided throughout the period. For sub-lines subjected to the image heating, variable data of $000_H$–$1FF_H$ is separated by use of $00_H$–$FF_H$ as a unit. Variable data of $000_H$–$0FF_H$ is provided for the first image heating. Variable data of $100_H$–$1FF_H$ is provided for the second image heating. If a sub-line is subjected to cooling in a stopped state, fixed data of $00_H$ is provided.

In FIGS. 15A–15D, a heating sequence is illustrated in which the heating elements are grouped into four. FIG. 15B depicts yellow recording. FIG. 15C depicts magenta recording. FIG. 15D depicts cyan recording. In the present embodiment, the heating sequence is different between the three colors, so that bias heating is differently effected. For example, see the period for recording the first sub-line in FIG. 15B. The heating elements of the first group are driven for bias heating. The heating elements of the second group are stopped, and left to stand in a cooling state without heating. The heating elements of the third group are driven for image heating with second partial image drive data. The heating elements of the fourth group are driven for image heating with first partial image drive data. In the drawings, a sign B designates the bias heating, K1 the first image heating, K2 the second image heating, and R the cooling period or stopped period.

While the second sub-line is recorded, operation succeeding to that having been made for the first sub-line is effected. To be precise, the heating elements of the first group are driven for image heating with first partial image drive data. The heating elements of the second group are driven for bias heating. The heating elements of the third group are stopped, and left to stand in a cooling state. The heating elements of the fourth group are driven for image heating with second partial image drive data. While the third sub-line is recorded, operation succeeding to that having been made for the second sub-line is effected. While the fourth sub-line is recorded, operation succeeding to that having been made for the third sub-line is effected. It is to be noted that the assignment of the processes to the groups are changeable in any suitable manner, and not limited to the example as shown in the drawing. The smallest unit pattern included in the heating sequence is indicated by the thick broken line.

Figure 16:
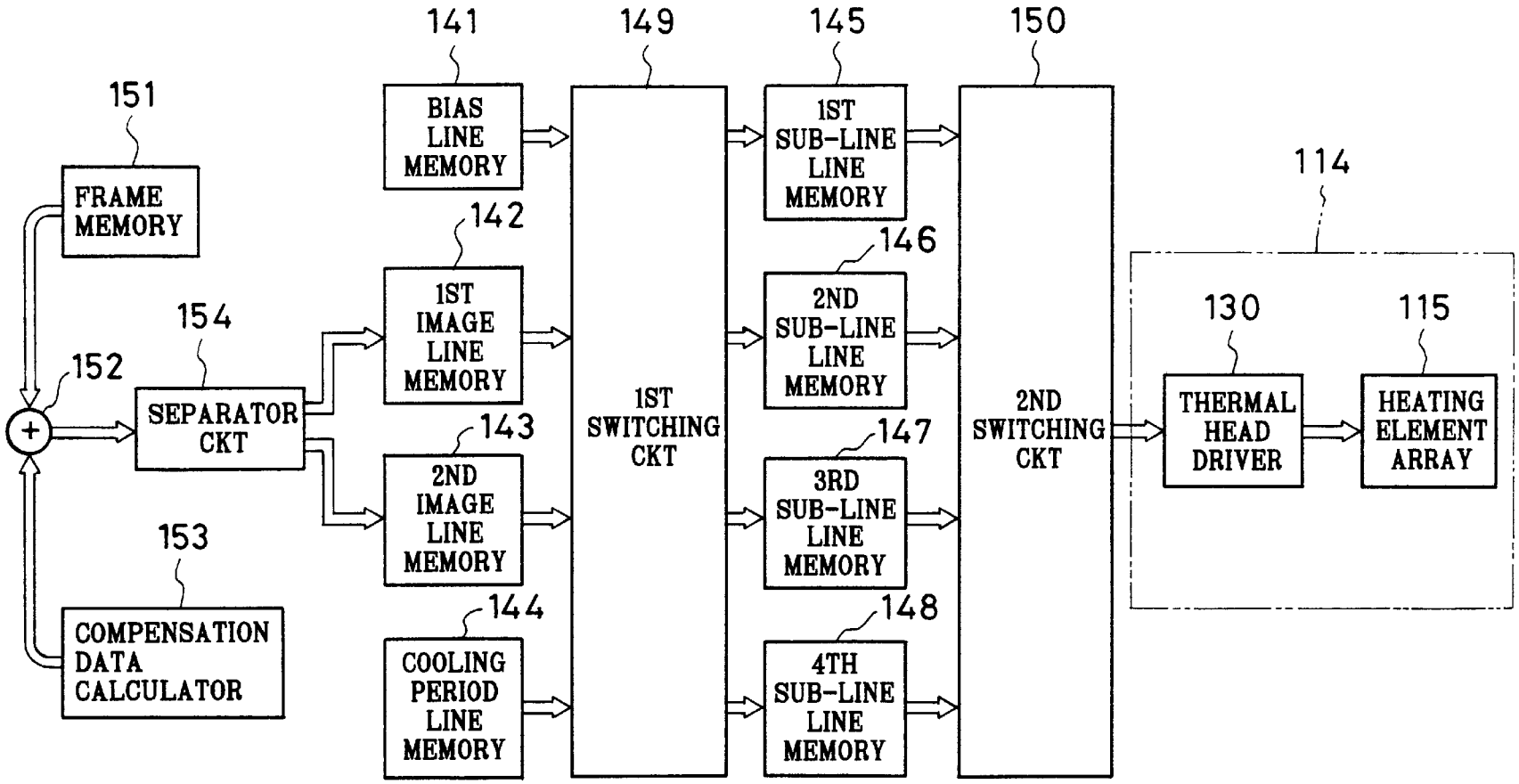
FIG. 16 is a block diagram schematically illustrating circuits of the thermal printer of FIGS. 15A–15D in which each one line is divided into four sub-lines.

In FIG. 16, circuitry for the above-described heating sequence is illustrated. Elements similar to those of FIG. 7 are designated with identical reference numerals. As the four groups and four sub-lines are used, two combinations of four line memories 141–148 are used, including a bias line memory 141, a first image line memory 142, a second image line memory 143, a cooling period line memory 144, a first sub-line line memory 145, a second sub-line line memory 146, a third sub-line line memory 147 and a fourth sub-line line memory 148. Also switching circuits 149 and 150 are combined, to send data to the thermal head driver 130.

Image data of the yellow, magenta and cyan colors are stored in a frame memory 151 in a manner separated color from color. The image data of one line is read from the frame memory 151 successively, and sent to an adder 152. Compensation data is sent from a compensation data calculator 153 to the adder 152 in synchronism with reading of one line from the frame memory 151. The compensation data includes color compensation data, shading compensation data, and data for compensation of irregularity in resistance of the heating elements. The shading compensation data is predetermined in accordance with the number of the lines to be recorded. The compensation data for irregularity in resistance is predetermined for each of the heating elements. The image data and the compensation data have a length of 8 bits, and are added up by the adder to become 9-bit data of $000_H$–1FFH, which is sent to a separator circuit 154.

The separator circuit 154 separates 9-bit compensated image data into first and second partial image pulses K1 and K2 by use of a length of one sub-line recording period as a unit. To be precise, if the ninth bit has a value of one (1), the separation is made to set $FF_H$ as K1, and set $00_H$–$FF_H$ as K2 of eight bits in accordance with the lower eight digits. In contrast, if the ninth bit has a value of zero (0), the separation is made to set $00_H$–$FF_H$ as K1 of eight bits in accordance with the lower eight digits, and set $00_H$ as K2. Then K1 is written to the first image line memory 142. K2 is written to the second image line memory 143. The bias line memory 141 previously stores fixed bias data of $FF_H$. The cooling period line memory 144 previously stores fixed stop data of $00_H$. It is to be noted that, instead of the bias line memory 141 and the cooling period line memory 144, data generators may be used for generating fixed data of $FF_H$ and $00_H$.

Figure 17A:
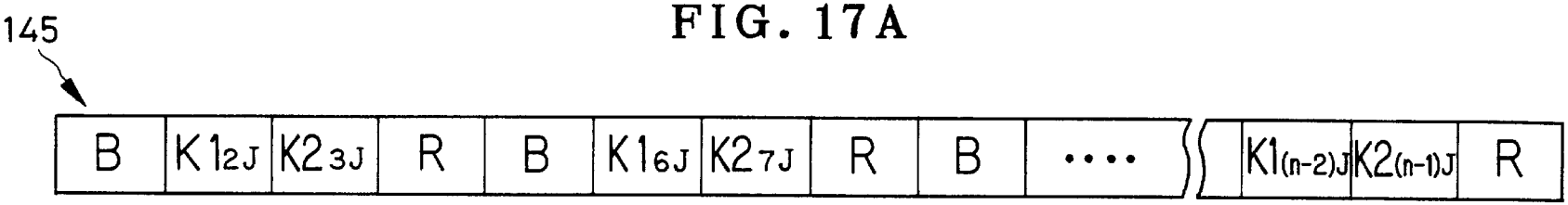
FIGS. 17A, 17B, 17C and 17D are explanatory views illustrating stored data respectively in first, second, third and fourth sub-line line memories.
Figure 17B:
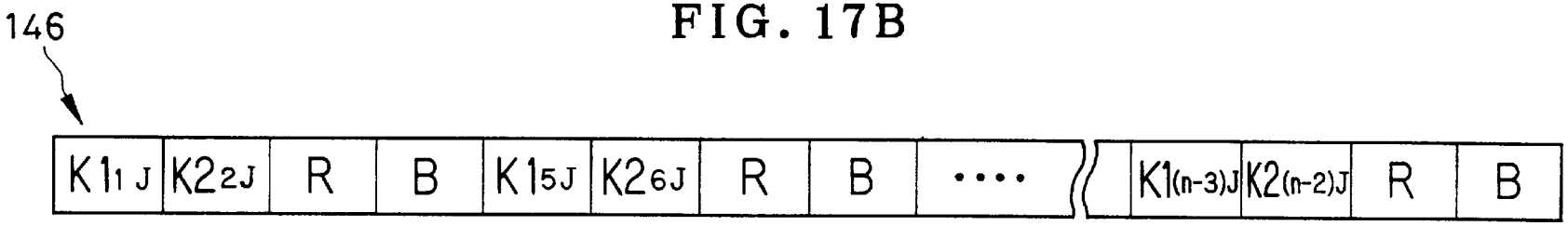
Figure 17C:
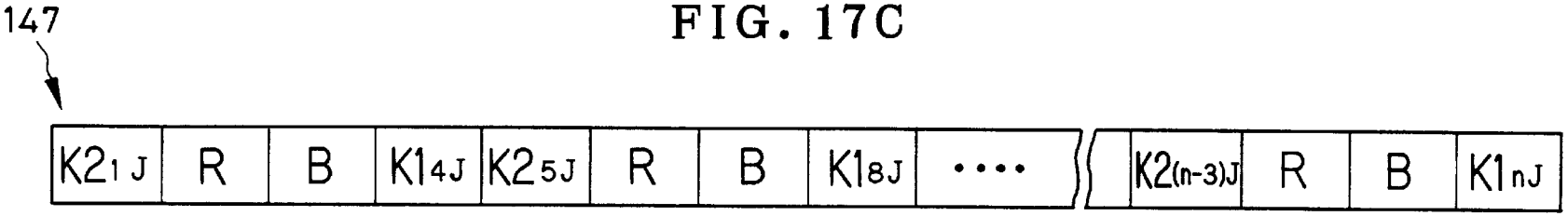
Figure 17D:
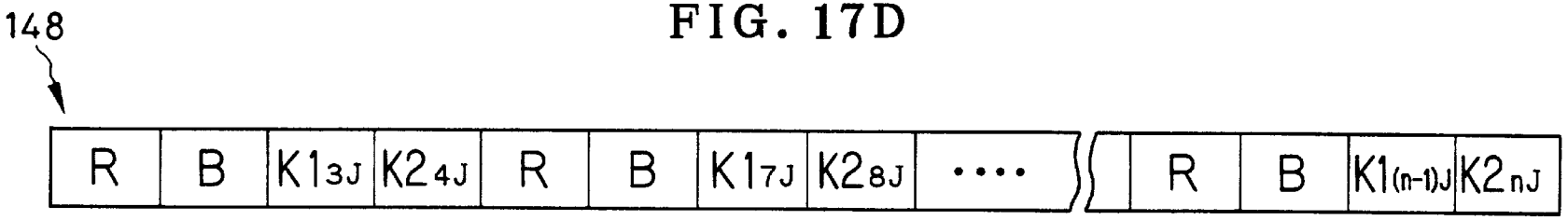
Figure 18:
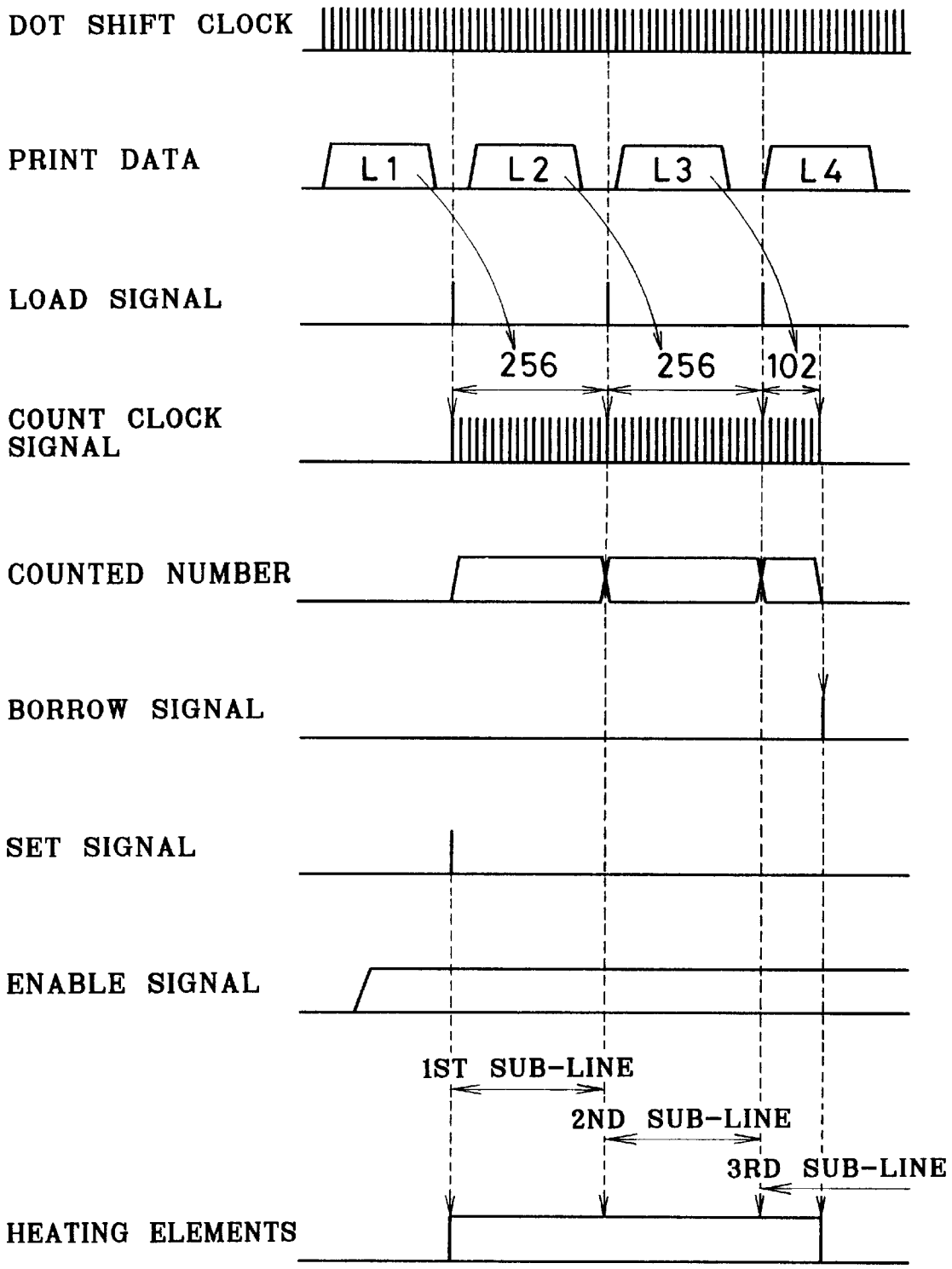
FIG. 18 is a timing chart illustrating operation of the circuits of FIG. 16.

The switching circuit 149 reads data from the line memories 141–144 serially pixel by pixel, and writes it to the line memories 145–148. In FIG. 17A, the first sub-line line memory 145 comes to store B, $K1_{2J}$, $K2_{3J}$, R, B, $K1_{6J}$, $K2_{7J}$, R, . . . , $K1_{(n-2)J}$, $K2_{(n-1)J}$, R in the order from the first heating element. In FIG. 17B, the second sub-line line memory 146 comes to store $K1_{1J}$, $K2_{2J}$, R, B, $K1_{5J}$, $K2_{6J}$, R, . . . , $K2_{(n-2)J}$, R, B in the order of the heating elements. In FIG. 17C, the third sub-line line memory 147 comes to store $K2_{1J}$, R, B, $K1_{4J}$, $K2_{5J}$, R, . . . , $K2_{(n-3)J}$, R, B, $K1_{nJ}$ in the order of the heating elements. In FIG. 17D, the fourth sub-line line memory 148 comes to store R, B, $K1_{3J}$, $K2_{4J}$, R, . . . , $K2_{(n-3)J}$, R, B, $K1_{(n-1)J}$, $K2_{nJ}$ in the order of the heating elements.

The switching circuit 150 changes over the line memories 145–148 and reads print data from them by one sub-line which is a ¼ line. The print data is sent by the switching circuit 150 to the thermal head driver 130. The thermal head driver 130, in the manner the same as the above embodiment, drives the heating elements $115_1$–$115_n$ according to the print data to apply heat to each recording layer. Thus heat energy according to the print data is applied to the recording layer to record dots of one line. See FIG. 18, which is a timing chart of operation of the thermal head driver 130.

In FIGS. 19A–19C, another preferred embodiment is illustrated, in which the heating sequence and the size of a sub-line are different between the three colors. In FIG. 19A, the grouping of the heating elements for yellow recording is depicted. The heating elements are grouped into five (5) groups which are substantially equal. The heating elements are arranged cyclically by one element in the order of the five groups. In other words, they are arranged in repetition of a pattern of A-B-C-D-E in the main scan direction.

The line recording period for recording dots of one line is divided by five (5) equally to obtain first to fifth sub-line recording periods. The image pulse is separated into first, second and third partial image pulses by use of a length of one sub-line recording period as a unit. In the first sub-line recording period, the five groups of the heating elements are respectively associated with application of the bias pulse, application of the first partial image pulse, application of the second partial image pulse, application of the third partial image pulse, and stop for the cooling state. In the second and later sub-line recording periods, the group of the heating elements having been supplied with the bias pulse are supplied with the first partial image pulse. The group of the heating elements having been supplied with the first partial image pulse are supplied with the second partial image pulse. The group of the heating elements having been supplied with the second partial image pulse are supplied with the third partial image pulse. The group of the heating elements having been supplied with the third partial image pulse are stopped for the cooling state. The group of the heating elements having been stopped are supplied with the bias pulse.

In the magenta recording, the heating sequence of FIG. 19B is used. The heating elements are grouped into first, second, third and fourth groups in a substantially equal manner. The heating elements are arranged cyclically by one element in the order of the groups. The line recording period for recording dots of one line is divided by four (4) equally to obtain first to fourth sub-line recording periods.

In the cyan recording, the heating sequence of FIG. 19C is used. The heating elements are grouped into first, second and third groups in a substantially equal manner. The heating elements are arranged cyclically by one element in the order of the groups. The line recording period for recording dots of one line is divided by three (3) equally to obtain first to third sub-line recording periods. In the first sub-line recording period, the five groups of the heating elements are respectively associated with application of the bias pulse, application of the image pulse, and stop for the cooling state. In the second and later sub-line recording periods, the group of the heating elements having been supplied with the bias pulse are supplied with the image pulse. The group of the heating elements having been supplied with the image pulse are stopped for the cooling state. The group of the heating elements having been stopped are supplied with the bias pulse.

In short, the range of the arranging pattern in the main scan direction is the smaller according to the depth of each of the three coloring layers. The bias heating in the line recording period can be set longer according to the layer depth. Therefore the bias heating can be preadjusted suitably for the different coloring layers without changing the drive voltage or the pulse width.

In the above embodiments, the bias heating and the image heating are effected by continuous powering, in other words with the single bias pulse and the single image pulse which may be divided only by a small number. Alternatively a train of a great number of pulses may be used for both of the bias heating and the image heating. When the bias heating is effected in any of the sub-line recording periods, a train of bias pulses are applied throughout the particular sub-line recording period.

In the above embodiments, the down counters are used in the thermal head driver 130 for the gradation control. Alternatively the present invention may be used in any thermal printer in which the gradation is controllable with a thermal head driver.

The heating elements $\mathbf{115}_1$–$\mathbf{115}_n$ are grouped into groups G1 and G2 in an alternate manner by one element. Moreover the heating elements $\mathbf{115}_1$–$\mathbf{115}_n$ can be grouped into two groups in an alternate manner at every two elements, or every three or more elements. In the above embodiment plural sub-lines are used to separate the image heating. Furthermore the bias heating is effected in separation by use of plural sub-lines.

In the above embodiments, the bias heat energy applies heat to the recording material 110 up to the temperature slightly short of the start of the color development of each coloring layer. When image heating of any small amount is effected after the bias heating, the recording material 110 starts being colored. It is to be noted that, in the present invention, the bias heating includes preheating, which is effected in a range free from lowering the image quality and including the temperature definitely smaller than that of the start of the color development.

In the above embodiments the thermal printer is one-head three-pass type in which the feeder rollers 111 convey the recording material 110 back and forth, and the single thermal head records the three colors successively. Furthermore it is possible to use the present invention in a three-head one-pass type in which three thermal head records the three colors while the recording material 110 is conveyed in a direction for one time.

Figure 20:
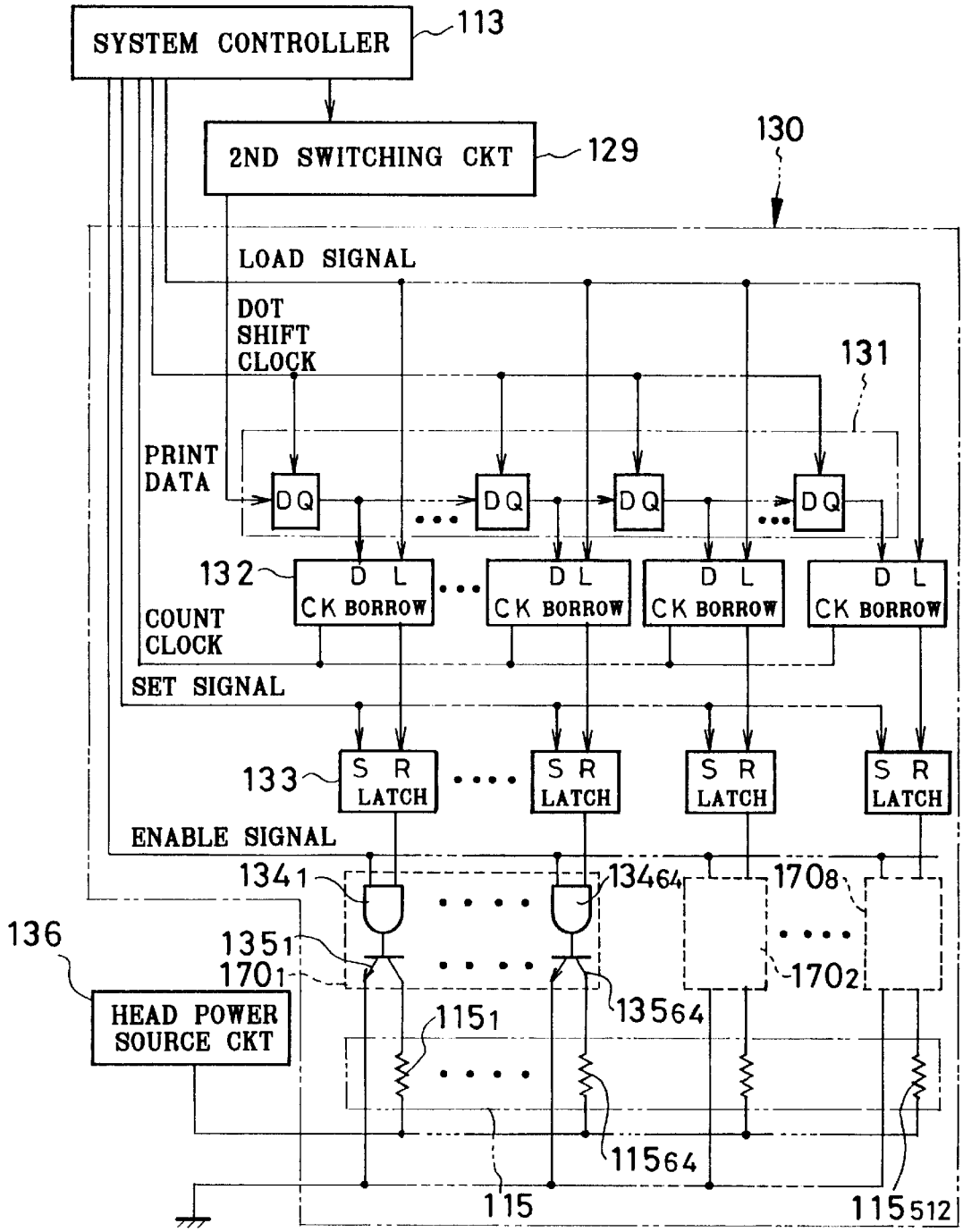
FIG. 20 is a block diagram schematically illustrating circuits of another preferred thermal printer in which each of eight driver ICs drives respectively 64 heating elements.

Note that the grouping of the heating elements can be determined by use of driver ICs, each of which drives a plurality of heating elements included in the array. In FIG. 20, a driver IC (integrated circuit) array 170 includes eight (8) driver ICs $\mathbf{170}_1$–$\mathbf{170}_8$. As one line consists of 512 pixels, each of the drive ICs $\mathbf{170}_1$–$\mathbf{170}_8$ includes the 64 AND gate arrays 134 and the transistors 135 in the same number. Elements similar to those illustrated in FIG. 12 are designated with identical reference numerals. The drive IC array $\mathbf{170}_1$–$\mathbf{170}_8$ may includes extra elements additional to the AND gate array $\mathbf{134}_1$–$\mathbf{134}_{64}$ and the transistors 135. Or the drive IC array $\mathbf{170}_1$–$\mathbf{170}_8$ may include only the transistors 135. The drive IC array $\mathbf{170}_1$–$\mathbf{170}_8$ has the feature of driving the heating element by the unit of plural elements, specifically 64 elements.

In FIG. 21A, the grouping of the heating elements is illustrated. First group G1 includes the heating elements $\mathbf{115}_1$–$\mathbf{115}_{64}$. Second group G2 includes the heating elements $\mathbf{115}_{65}$–$\mathbf{115}_{128}$. Third group G3 includes the heating elements $\mathbf{115}_{129}$–$\mathbf{115}_{192}$. Fourth group G4 includes the heating elements $\mathbf{115}_{193}$–$\mathbf{115}_{256}$. The remaining heating elements including the heating element $\mathbf{115}_{257}$ are grouped into groups G1–G4.

In FIGS. 21B, 21C and 21D, heating sequences are illustrated. Each one of the driver ICs $\mathbf{170}_1$–$\mathbf{170}_8$ drives heating elements included in any of groups G1–G4. It is possible to effect a simple control of driving the thermal head 114. As the heating sequences are different between the three colors, occurrence of moire can be avoided. The number of the groups is four (4), but may be any number of at least two (2).

In FIGS. 22A–22D, another preferred embodiment is depicted, in which the number of the groups of the heating elements is determined different between the colors to be recorded. For the yellow recording, see FIG. 22A. The driver ICs $\mathbf{170}_1$–$\mathbf{170}_8$ are grouped into four groups G1–G4, to drive the heating elements in the sequence of FIG. 22B. For the magenta and cyan recording, see FIG. 22C. The driver ICs $\mathbf{170}_1$–$\mathbf{170}_8$ are grouped into two groups G1 and G2, to drive the heating elements in the sequence of FIG. 22D. Note that the magenta and cyan recording requires higher bias heat energy than the yellow recording. The bias heating for magenta and cyan is effected by use of two of the four sub-line recording periods into which the one line recording period is divided.

In the above embodiment, plural image pulses into which the original image pulse is divided are applied successively. Alternatively it is possible to apply a first partial image pulse, a bias pulse, and then a second partial image pulse to one of the groups of the heating elements, respectively by use of one sub-line recording period.

In the yellow recording in the embodiment of FIGS. 19A–19C, the yellow image pulse is virtually separated into the first, second and third partial image pulses by a separator circuit suitably constructed. According to the operation of the separator circuit, if a time width of the yellow image pulse is equal to or less than a respective length of the sub-line recording periods of the yellow, the first partial image pulse is generated with the time width of the yellow image pulse. If the time width of the yellow image pulse is T or more times as much as the respective length of the sub-line recording periods of the yellow, first to Tth of the partial image pulses are generated with the respective length of the sub-line recording periods of the yellow, wherein $1 \leqq T \leqq 3$. If the time width of the yellow image pulse is in a range from T times to T+1 times as much as the respective length of the sub-line recording periods of the yellow, a difference is determined between the time width of the yellow image pulse and the respective length of the sub-line recording periods of the yellow, to generate a (T+1)th of the partial image pulses with a time width of the difference.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printing method of thermal recording to a thermosensitive recording material by one line with a thermal head, in which said thermal head has an array of plural heating elements arranged in line in a main scan direction, said heating elements are driven while said recording material is conveyed in a sub scan direction crosswise to said main scan direction, for forming one dot in said main scan direction, for forming one dot in said one line, said thermal printing method comprising the steps of:

grouping said heating elements into first and second groups;

driving said first group of said heating elements by a first drive pulse train, said first group of said heating elements starting being driven at a start of a line recording period adapted to recording said one line, and finishing being driven during said line recording period; and driving said second group of said heating elements by a second drive pulse train, said second group of said heating elements starting being driven during said line recording period, and finishing being driven at an end of said line recording period;

generating first comparison data for said first group, said first comparison data being predetermined to step up serially from a minimum;

generating second comparison data for said second group, said second comparison data being predetermined to step down serially from a maximum;

comparing said first comparison data with heating data determined for said first group, so as to generate said first drive pulse train in a number according to said heating data; and comparing said second comparison data with heating data determined for said second group, so as to generate said second drive pulse train in a number according to said heating data.

2. A thermal printing method as defined in claim 1, wherein said heating elements are in a predetermined cyclic arranging pattern, said arranging pattern is constituted by n of said heating elements included in said first group, and n of said heating elements disposed adjacent thereto and included in said second group, and $n \geqq 1$.

3. A thermal printing method as defined in claim 2, wherein a number of heating elements included in said first group among said heating elements is substantially equal to a number of heating elements included in said second group among said heating elements.

4. A thermal printing method as defined in claim 3, wherein said dot to be recorded with said drive pulses has a maximum density, a length of one of said first drive pulse train and said second drive pulse train is substantially a half of said line recording period.

5. A thermal printing method as defined in claim 3, wherein said dot to be recorded with said drive pulses has a maximum density, a length of one of said first drive pulse train and said second drive pulse train is shorter than said line recording period and longer than a half of said line recording period.

6. A thermal printer for thermal recording to a thermosensitive recording material by one line with a thermal head, in which said thermal head has an array of plural heating elements arranged in line in a main scan direction, said heating elements are driven while said recording material is conveyed in a sub scan direction crosswise to said main scan direction, for forming one dot in said one line, said thermal printer comprising:

said heating elements being grouped into first and second groups;

a comparison data generator for generating first comparison data for said first group of said heating elements, and for generating second comparison data for said second group of said heating elements, said first comparison data stepping serially from a minimum up to a maximum, said second comparison data stepping serially from a maximum down to a minimum;

a line memory for storing heating data for said first group according to ones of said heating elements included in said first group, and for storing heating data for said second group according to ones of said heating elements included in said second group;

a comparator for comparing first comparison data with said heating data for said first group, and for comparing second comparison data with said heating data for said second group, to generate first drive data train for said first group and second drive data train for said second group; and a heating element driver for converting said first drive data train into a first drive pulse train to drive said first group, and for converting said second drive data train into a second drive pulse train to drive said second group, said first drive pulse train starting at a start of a recording of said one line, and finishing during recording of said one line, and said second drive pulse train starting during recording of one line, and finishing at an end of recording of said one line;

wherein said heating elements are in a predetermined cyclic arranging pattern, said arranging pattern is constituted by n of said heating elements included in said first group, and n of said heating elements disposed adjacent thereto and included in said second group, and n>1;

wherein said comparison data generator includes:

a signal generator circuit for generating said first comparison data in a binary form;

an inverter for inverting said first comparison data by one binary digit, so as to generate said second comparison data in a binary form; and a data selector for selecting one of said first and second comparison data alternately, and for sending to said comparator said selected one of said first and second comparison data.

7. A thermal printer as defined in claim 6, wherein a number of heating elements included in said first group among said heating elements is substantially equal to a number of heating elements included in said second group among said heating elements.

8. A thermal head driving method for a thermal head thermally recording to a thermosensitive recording material by one line, in which said recording material includes at least one thermosensitive coloring layer, said thermal head has an array of plural heating elements arranged in line in a main scan direction, said heating elements are supplied with at least one bias pulse and at least one image pulse while said recording material is conveyed in a sub scan direction crosswise to said main scan direction, for forming one dot in said one line, said bias pulse applies bias heat energy directly short of coloring said coloring layer, and said image pulse applies image heat energy in accordance with coloring density of said dot, said thermal head driving method comprising the steps of:

grouping said heating elements in to first to Nth groups, where N≧2;

setting first to Nth sub-line recording periods by dividing N into a line recording period adapted for record of said one line; and driving said first to Nth groups respectively by first to Nth drive patterns to record said one line, said first to Nth drive patterns being different from one another, and adapted respectively to record said one dot by driving one of said heating elements, wherein each of said first to Nth drive patterns supplies said bias pulse throughout at least one of said sub-line recording periods, and supplies said image pulse during at least one of remaining ones of said sub-line recording periods.

9. A thermal head driving method as defined in claim 8, wherein said at least one sub-line recording period where said bias pulse is supplied is directly before or directly after said at least one remaining sub-line recording period where said image pulse is supplied.

10. A thermal head driving method as defined in claim 9, wherein each of said drive patterns further includes a cooling period in which said heating elements stop being driven, and said cooling period is directly before or directly after said at least one sub-line recording period where said bias pulse is supplied.

11. A thermal head driving method as defined in claim 10, wherein said heating elements are in a predetermined cyclic arranging pattern, said arranging pattern is constituted by a serial arrangement of said first to Nth groups, and each of said first to Nth groups includes n of said heating elements.

12. A thermal head driving method as defined in claim 11, wherein N=n=2.

13. A thermal head driving method as defined in claim 9, wherein said at least one coloring layer comprises first to third coloring layers arranged in sequence from a recording surface of said recording material, said first to third coloring layers are colorable respectively in first to third colors, and said first to third colors include yellow, magenta and cyan;

wherein said drive patterns are different between at least two of said first to third colors.

14. A thermal head driving method as defined in claim 13, wherein N is different between said first to third colors.

15. A thermal head driving method as defined in claim 14, wherein N=N1 for said first color, N=N2 for said second color, and N=N3 for said third color, and N3<N1.

16. A thermal head driving method as defined in claim 8, wherein said thermal head is driven by at least N driver ICs, and said heating elements of one of said groups are driven by at least one of said driver ICs.

17. A thermal head driving method for a thermal head thermally recording to a thermosensitive recording material by one line, in which said recording material includes first to third thermosensitive coloring layers arranged in sequence from a recording surface, said first to third coloring layers are colorable respectively in first to third colors, and said first to third colors include yellow, magenta and cyan, said thermal head has an array of plural heating elements arranged in line in a main scan direction, said heating elements are supplied with at least one bias pulse and at least one image pulse while said recording material is conveyed in a sub scan direction crosswise to said main scan direction, for forming one dot in said one line, said bias pulse applies bias heat energy directly short of coloring said coloring layer, and said image pulse applies image heat energy in accordance with coloring density of said dot, said thermal head driving method comprising the steps of:

grouping said heating elements into first and second groups;

setting first and second sub-line recording periods by dividing two into a line recording period adapted for recording of said one line;

during said first sub-line recording period, applying said bias pulse to said heating elements of said first group, and said image pulse to said heating elements of said second group; and during said second sub-line recording period, applying said bias pulse to said heating elements of said second group, and said image pulse to said heating elements of said first group, so that said heating element array applies said bias heat energy throughout both of said first and second sub-line recording periods.

18. A thermal head driving method as defined in claim 17, wherein said heating elements are in a predetermined cyclic arranging pattern, said arranging pattern is predetermined by arranging at least one of said heating elements included in said first group, and at least one of said heating elements included in said second group; and said arranging pattern is different between at least two of said first to third colors.

19. A thermal head driving method as defined in claim 17, wherein selective application of said bias pulse and said image pulse between said first and second groups is effected for at least one of said first to third colors;

during said first sub-line recording period for at least one of remaining two of said first to third colors, said bias pulse is applied to said first and second groups; and during said second sub-line recording period for said at least one remaining color, said image pulse is applied to said first and second groups.

20. A thermal head driving method for a thermal head thermally recording to a thermosensitive recording material by one line, in which said recording material includes first to third thermosensitive coloring layers arranged in sequence from a recording surface, said first to third coloring layers are colorable respectively in first to third colors, and said first to third colors include yellow, magenta and cyan, said thermal head has an array of plural heating elements arranged in line in a main scan direction, said heating elements are supplied with at least one bias pulse and at least one image pulse while said recording material is conveyed in a sub scan direction crosswise to said main scan direction, for forming one dot in said one line, said bias pulse applies bias heat energy directly short of coloring said coloring layer, and said image pulse applies image heat energy in accordance with coloring density of said dot, said thermal head driving method comprising the steps of:

grouping said heating elements into first to fourth groups, cyclically to arrange ones of said heating elements included respectively in said first to fourth groups;

setting first to fourth sub-line recording periods by dividing four into a line recording period adapted for recording of said one line;

separating said image pulse into first and second partial image pulses;

driving said first to fourth groups respectively by different drive patterns;

wherein during a Kth of said sub-line recording periods, said bias pulse is applied to said heating elements of a Kth of said groups, where $1 \leqq K \leqq 4$;

during a (K+1)th or (K−3)th of said sub-line recording periods, said first partial image pulse is applied to said heating elements of said Kth group;

during a (K+2)th or (K−2)th of said sub-line recording periods, said second partial image pulse is applied to said heating elements of said Kth group; and during a (K+3)th or (K−1)th of said sub-line recording periods, said heating elements of said Kth group are kept in a cooling state.

21. A thermal head driving method as defined in claim 20, wherein said drive patterns are different between at least two of said first to third colors.

22. A thermal head driving method as defined in claim 20, wherein a width of said image pulse with which said dot is recorded at a maximum density is 2T where T is each length of said sub-line recording periods;

if a width W of said image pulse is equal to or less than T, then said second partial image pulse has a zero width;

if said width W of said image pulse is from T to 2T, then said second partial image pulse has a width from W-T to T.

23. A thermal head driving method as defined in claim 22, wherein said width of said image pulse is represented by binary coded data of S bits;

if a head digit of said binary coded data is zero, then a width of said first partial image pulse is represented by binary coded data of S−1 bits;

if said head digit of said binary coded data is one, then a width of said first partial image pulse is T, and a width of said second partial image pulse is represented by binary coded data of S−1 bits.

24. A thermal head driving method for a thermal head thermally recording to a thermosensitive recording material by one line, in which said recording material includes first to third thermosensitive coloring layers arranged in sequence from a recording surface, said first to third coloring layers are colorable respectively in first to third colors, and said first to third colors include yellow, magenta and cyan, said thermal head has an array of plural heating elements arranged in line in a main scan direction, said heating elements are supplied with first-color, second-color and third-color bias pulses and first-color, second-color and third-color image pulses while said recording material is conveyed in a sub scan direction crosswise to said main scan direction, for forming one dot in said one line, said first-color, second-color and third-color bias pulses apply respective bias heat energy directly short of coloring said first to third coloring layers, and said first-color, second-color and third-color image pulses apply respective image heat energy in accordance with coloring density of said dot in said first to third colors, said thermal head driving method comprising the steps of:

grouping said heating elements into first to Pth groups for thermal recording of said first color, where $P \geqq 5$, cyclically to arrange ones of said heating elements included respectively in said first to Pth groups, to define a first unit arranging pattern;

setting first to Pth sub-line recording periods by dividing P into a line recording period adapted for recording of said one line of said first color;

separating said first-color image pulse into first to (P−2)th partial image pulses;

driving said first to Pth groups respectively by different drive patterns;

wherein during a Kth of said sub-line recording periods of said first color, said first-color bias pulse is applied to said heating elements of a Kth of said groups, where $1 \leqq K \leqq P$;

during a (K+X)th or {K−(P−X)}th of said sub-line recording periods of said first color, an Xth of said partial image pulses is applied to said heating elements of said Kth group, where $1 \leqq X \leqq P-2$;

during a {K+(P−1)}th or (K−1)th of said sub-line recording periods of said first color, said heating elements of said Kth group are kept in a cooling state;

grouping said heating elements into first to Qth groups for thermal recording of said second color, where $Q<P$, cyclically to arrange ones of said heating elements included respectively in said first to Qth groups, to define a second unit arranging pattern;

setting first to Qth sub-line recording periods by dividing Q into a line recording period adapted for recording of said one line of said second color;

driving said first to Qth groups respectively by different drive patterns;

wherein during an Mth of said sub-line recording periods of said second color, said second-color bias pulse is applied to said heating elements of an Mth of said groups, where $1 \leqq M \leqq Q$;

directly before or directly after said Mth sub-line recording period and during said first to Qth sub-line recording periods of said second color, said second-color image pulse is applied to said heating elements of said Mth group;

grouping said heating elements into first to Rth groups for thermal recording of said third color, where $R \leqq Q$, cyclically to arrange ones of said heating elements included respectively in said first to Rth groups, to define a third unit arranging pattern;

setting first to Rth sub-line recording periods by dividing R into a line recording period adapted for record of said one line of said third color;

driving said first to Rth groups respectively by different drive patterns;

wherein during an Nth of said sub-line recording periods of said third color, said third-color bias pulse is applied to said heating elements of an Nth of said groups, where $1 \leqq N \leqq R$; and directly before or directly after said Nth sub-line recording period and during said first to Rth sub-line recording periods of said third color, said third-color image pulse is applied to said heating elements of said Nth group.

25. A thermal head driving method as defined in claim 24, wherein $Q \geqq 4$; and further comprising a step of separating said second-color image pulse into first to (Q−2)th partial image pulses; wherein during an (M+Y)th or {M−(Q−Y)}th of said sub-line recording periods of said second color, a Yth of said partial image pulses is applied to said heating elements of said Mth group, where $1 \leqq Y \leqq Q-2$; and during an {M+(Q−1)}th or (M−1)th of said sub-line recording periods of said second color, said heating elements of said Mth group are kept in a cooling state.

26. A thermal head driving method as defined in claim 24, wherein each of said first, second and third unit arranging patterns includes a predetermined number of ones of said heating elements, said ones of said heating elements being associated with a respective one of said groups.

27. A thermal head driving method as defined in claim 26, wherein said thermal head is driven by at least P driver ICs, said heating elements of one of said groups are driven by at least one of said driver ICs.

28. A thermal head driving method as defined in claim 24, wherein a width of said first-color image pulse with which said dot is recorded at a maximum density is $(P-2)\cdot T$ where T is each length of said sub-line recording periods of said first color;

if a width W of said first-color image pulse is equal to or less than T, then said second to (P−2)th partial image pulses have a zero width;

if said width W of said first-color image pulse is from $(X-1)\cdot T$ to $X\cdot T$, then said Xth partial image pulse has a width from $W-\{(X-1)\cdot T\}$ to T.

29. A thermal printer for thermal recording to a thermosensitive recording material by one line with a thermal head, in which said recording material includes at least one thermosensitive coloring layer, and in which said thermal head has an array of plural heating elements arranged in line in a main scan direction, said heating elements are supplied with at least one bias pulse and at least one image pulse while said recording material is conveyed in a sub scan direction crosswise to said main scan direction, for forming one dot in said one line, said bias pulse applying bias heat energy directly short of coloring said coloring layer, and said image pulse applying image heat energy in accordance with image data related to coloring density of said dot, said thermal printer comprising:

a bias line memory for storing bias data of said one line;

at least one image line memory for storing image drive data of said one line, said image drive data being determined in accordance with said image data;

first to Nth sub-line line memories adapted for recording of first to Nth sub-lines, said first to Nth sub-lines being recordable during respectively first to Nth sub-line recording periods, said first to Nth sub-line recording periods being set by dividing N into a line recording period adapted for recording of said one line, where $N \geqq 2$;

said heating elements being grouped into first to Nth groups;

a first switching circuit for designating said first to Nth sub-line line memories adapted to writing of said bias data and said image drive data thereto, wherein a Kth of said sub-line line memories stores said bias data associated with said heating elements of a Kth of said first to Nth groups, and wherein at least one of said first to Nth sub-line line memories different from said Kth sub-line line memory stores said image drive data associated with said heating elements of said Kth group, where $1 \leqq K \leqq N$;

a second switching circuit for designating said first to Nth sub-line line memories respectively for said first to Nth sub-line recording periods adapted to reading of said bias data and said image drive data therefrom;

a heating element driver for producing said bias pulse and said image pulse from said bias data and said image drive data for said first to Nth sub-line recording periods, to drive said heating elements therewith.

30. A thermal printer as defined in claim 29, wherein said heating element driver includes:

a clock generator for generating a clock signal; and a counter for counting said clock signal while supplied with said bias data and said image drive data by said second switching circuit, to measure time according to values of said bias data and said image drive data, said bias pulse and said image pulse being output with time widths respectively determined by said values of said bias data and said image drive data.

31. A thermal printer as defined in claim 29, wherein N=4;

further comprising a separator circuit for separating said image drive data into first and second partial image drive data;

wherein said at least one image line memory comprises first and second image line memories respectively for storing said first and second partial image drive data;

said first switching circuit sends a (K+1)th or (K−3)th of said sub-line line memories said first partial image drive data associated with said heating elements of said Kth group, and sends a (K+2)th or (K−2)th of said sub-line line memories said second partial image drive data associated with said heating elements of said Kth group.

32. A thermal printer as defined in claim 31, further comprising a cooling period line memory for storing stop data adapted to stopping said heating elements to keep a cooling state;

wherein said first switching circuit sends a (K+3)th or (K−1)th of said sub-line line memories said stop data associated with said heating elements of said Kth group.

33. A thermal printer as defined in claim 31, wherein a width of said image pulse with which said dot is recorded at a maximum density is two times each length of said sub-line recording periods, and is represented by maximum image drive data having a size 2T;

said separator circuit, if a size W of said image drive data is equal to or less than T, sets said second partial image drive data with a zero size, and if said size W of said image drive data is from T to 2T, sets said second partial image drive data with a size from W-T to T.

* * * * *